US008264914B2

(12) United States Patent
Baba

(10) Patent No.: US 8,264,914 B2
(45) Date of Patent: Sep. 11, 2012

(54) ELECTRONIC TIMEPIECE AND TIME ADJUSTMENT METHOD FOR AN ELECTRONIC TIMEPIECE

(75) Inventor: Norimitsu Baba, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 188 days.

(21) Appl. No.: 12/881,602

(22) Filed: Sep. 14, 2010

(65) Prior Publication Data

US 2011/0063952 A1 Mar. 17, 2011

(30) Foreign Application Priority Data

Sep. 15, 2009 (JP) ..... 2009-213224

(51) Int. Cl.
*G04C 11/02* (2006.01)

(52) U.S. Cl. ..... 368/47

(58) Field of Classification Search ..... 368/47, 368/46, 21; 701/478; 342/357.51, 357.52; 375/354

See application file for complete search history.

(56) References Cited

U.S. PATENT DOCUMENTS

| | | | | |
|---|---|---|---|---|
| 6,381,701 | B1 * | 4/2002 | Takai | 713/400 |
| 6,563,765 | B1 * | 5/2003 | Ishigaki | 368/47 |
| 7,372,779 | B2 * | 5/2008 | Takada et al. | 368/21 |
| 7,385,876 | B2 * | 6/2008 | Ihara et al. | 368/21 |
| 7,715,279 | B2 * | 5/2010 | Urano et al. | 368/47 |
| 7,813,225 | B2 * | 10/2010 | Urano | 368/47 |
| 2007/0276593 | A1 | 11/2007 | Mutoh | |

FOREIGN PATENT DOCUMENTS

| | | |
|---|---|---|
| JP | 2000-352583 | 12/2000 |
| JP | 2001-228271 | 8/2001 |
| JP | 2002-090441 | 3/2002 |

* cited by examiner

*Primary Examiner* — Edwin A. Leon

(57) ABSTRACT

An electronic timepiece wherein, when the week number indicates an n-th cycle from a specific reference date as a cycle number, a date determination information setting unit sets the date determination information using a partial unit that is a different number in each date corresponding to the same week number in a plurality of consecutive cycle numbers, and the date determination unit acquires the date in each cycle number identified by the week number and time of week based on week number cycle information correlating week numbers, cycle numbers, and dates, and determines in which of these dates the partial unit matches the date determination information.

10 Claims, 28 Drawing Sheets

| WEEK NUMBER | CYCLE NUMBER | | | | | | | | | |
|---|---|---|---|---|---|---|---|---|---|---|
| | 1 | 2 | 3 | 4 | 5 | 6 | 7 | 8 | 9 | 10 |
| 0 | 1980/1/6 | 1999/8/22 | 2019/4/7 | 2038/11/21 | 2058/7/7 | 2078/2/20 | 2097/10/6 | 2117/5/23 | 2137/1/6 | 2156/8/22 |
| : | : | : | : | : | : | : | : | : | : | : |
| 645 | 1992/5/17 | 2012/1/1 | 2031/8/17 | 2051/4/2 | 2070/11/16 | 2090/7/2 | 2110/2/16 | 2129/10/2 | 2149/5/18 | 2169/1/1 |
| : | : | : | : | : | : | : | : | : | : | : |
| 1023 | 1999/8/15 | 2019/3/31 | 2038/11/14 | 2058/6/30 | 2078/2/13 | 2097/9/29 | 2117/5/16 | 2136/12/30 | 2156/8/15 | 2176/3/31 |

FIG. 4

| WEEK NUMBER | WN CYCLE TABLE | | | | | | | | |
|---|---|---|---|---|---|---|---|---|---|
| | A | B | C | D | E | F | G | H | I |
| 645 | 2012/1/1 | 2031/8/17 | 2051/4/2 | 2070/11/16 | 2090/7/2 | 2110/2/16 | 2129/10/2 | 2149/5/18 | 2169/1/1 |
| 646 | 2012/1/8 | 2031/8/24 | 2051/4/9 | 2070/11/23 | 2090/7/9 | 2110/2/23 | 2129/10/9 | 2149/5/25 | 2169/1/8 |
| : | : | : | : | : | : | : | : | : | : |
| 1023 | 2019/3/31 | 2038/11/14 | 2058/6/30 | 2078/2/13 | 2097/9/29 | 2117/5/16 | 2136/12/30 | 2156/8/15 | 2176/3/31 |
| 0 | 2019/4/7 | 2038/11/21 | 2058/7/7 | 2078/2/20 | 2097/10/6 | 2117/5/23 | 2137/1/6 | 2156/8/22 | 2176/4/7 |
| : | : | : | : | : | : | : | : | : | : |
| 644 | 2031/8/10 | 2051/3/26 | 2070/11/9 | 2090/6/25 | 2110/2/9 | 2129/9/25 | 2149/5/11 | 2168/12/25 | 2188/8/10 |

FIG. 5

| WEEK NUMBER | WN CYCLE TABLE | | | | | | | | |
|---|---|---|---|---|---|---|---|---|---|
| | A | B | C | D | E | F | G | H | I |
| 645 | 1 | 17 | 2 | 16 | 2 | 16 | 2 | 18 | 1 |
| 646 | 8 | 24 | 9 | 23 | 9 | 23 | 9 | 25 | 8 |
| : | : | : | : | : | : | : | : | : | : |
| 1023 | 31 | 14 | 30 | 13 | 29 | 16 | 30 | 15 | 31 |
| 0 | 7 | 21 | 7 | 20 | 6 | 23 | 6 | 22 | 7 |
| : | : | : | : | : | : | : | : | : | : |
| 644 | 10 | 26 | 9 | 25 | 9 | 25 | 11 | 25 | 10 |

FIG. 6

| WEEK NUMBER | A | B | C |
|---|---|---|---|
| 645 | 1 | 17 | 2 |
| 646 | 8 | 24 | 9 |
| 647 | 15 | 31 | 16 |
| 648 | 22 | 7 | 23 |
| 649 | 29 | 14 | 30 |
| 650 | 5 | 21 | 7 |
| 651 | 12 | 28 | 14 |
| 652 | 19 | 5 | 21 |
| 653 | 26 | 12 | 28 |
| 654 | 4 | 19 | 4 |
| 655 | 11 | 26 | 11 |
| 656 | 18 | 2 | 18 |
| 657 | 25 | 9 | 25 |
| 658 | 1 | 16 | 2 |
| 659 | 8 | 23 | 9 |
| 660 | 15 | 30 | 16 |
| 661 | 22 | 7 | 23 |
| 662 | 29 | 14 | 30 |
| 663 | 6 | 21 | 6 |
| 664 | 13 | 28 | 13 |
| 665 | 20 | 4 | 20 |
| 666 | 27 | 11 | 27 |
| 667 | 3 | 18 | 3 |
| 668 | 10 | 25 | 10 |
| 669 | 17 | 1 | 17 |
| 670 | 24 | 8 | 24 |
| 671 | 1 | 15 | 1 |
| 672 | 8 | 22 | 8 |
| 673 | 15 | 29 | 15 |
| 674 | 22 | 7 | 22 |
| 675 | 29 | 14 | 29 |
| 676 | 5 | 21 | 5 |
| 677 | 12 | 28 | 12 |
| 678 | 19 | 4 | 19 |
| 679 | 26 | 11 | 26 |
| 680 | 2 | 18 | 3 |
| 681 | 9 | 25 | 10 |
| 682 | 16 | 2 | 17 |
| 683 | 23 | 9 | 24 |
| 684 | 30 | 16 | 31 |

| WEEK NUMBER | A | B | C |
|---|---|---|---|
| 685 | 7 | 23 | 7 |
| 686 | 14 | 30 | 14 |
| 687 | 21 | 6 | 21 |
| 688 | 28 | 13 | 28 |
| 689 | 4 | 20 | 4 |
| 690 | 11 | 27 | 11 |
| 691 | 18 | 4 | 18 |
| 692 | 25 | 11 | 25 |
| 693 | 2 | 18 | 3 |
| 694 | 9 | 25 | 10 |
| 695 | 16 | 1 | 17 |
| 696 | 23 | 8 | 24 |
| 697 | 30 | 15 | 31 |
| 698 | 6 | 22 | 7 |
| 699 | 13 | 29 | 14 |
| 700 | 20 | 5 | 21 |
| 701 | 27 | 12 | 28 |
| 702 | 3 | 19 | 5 |
| 703 | 10 | 26 | 12 |
| 704 | 17 | 3 | 19 |
| 705 | 24 | 10 | 26 |
| 706 | 3 | 17 | 2 |
| 707 | 10 | 24 | 9 |
| 708 | 17 | 31 | 16 |
| 709 | 24 | 7 | 23 |
| 710 | 31 | 14 | 30 |
| 711 | 7 | 21 | 7 |
| 712 | 14 | 28 | 14 |
| 713 | 21 | 5 | 21 |
| 714 | 28 | 12 | 28 |
| 715 | 5 | 19 | 4 |
| 716 | 12 | 26 | 11 |
| 717 | 19 | 2 | 18 |
| 718 | 26 | 9 | 25 |
| 719 | 2 | 16 | 1 |
| 720 | 9 | 23 | 8 |
| 721 | 16 | 30 | 15 |
| 722 | 23 | 6 | 22 |
| 723 | 30 | 13 | 29 |
| 724 | 7 | 20 | 6 |

| WEEK NUMBER | A | B | C |
|---|---|---|---|
| 725 | 14 | 27 | 13 |
| 726 | 21 | 6 | 20 |
| 727 | 28 | 13 | 27 |
| 728 | 4 | 20 | 3 |
| 729 | 11 | 27 | 10 |
| 730 | 18 | 3 | 17 |
| 731 | 25 | 10 | 24 |
| 732 | 1 | 17 | 1 |
| 733 | 8 | 24 | 8 |
| 734 | 15 | 1 | 15 |
| 735 | 22 | 8 | 22 |
| 736 | 29 | 15 | 29 |
| 737 | 6 | 22 | 5 |
| 738 | 13 | 29 | 12 |
| 739 | 20 | 5 | 19 |
| 740 | 27 | 12 | 26 |
| 741 | 3 | 19 | 2 |
| 742 | 10 | 26 | 9 |
| 743 | 17 | 3 | 16 |
| 744 | 24 | 10 | 23 |
| 745 | 1 | 17 | 2 |
| 746 | 8 | 24 | 9 |
| 747 | 15 | 31 | 16 |
| 748 | 22 | 7 | 23 |
| 749 | 29 | 14 | 30 |
| 750 | 5 | 21 | 6 |
| 751 | 12 | 28 | 13 |
| 752 | 19 | 4 | 20 |
| 753 | 26 | 11 | 27 |
| 754 | 2 | 18 | 4 |
| 755 | 9 | 25 | 11 |
| 756 | 16 | 2 | 18 |
| 757 | 23 | 9 | 25 |
| 758 | 2 | 16 | 1 |
| 759 | 9 | 23 | 8 |
| 760 | 16 | 30 | 15 |
| 761 | 23 | 6 | 22 |
| 762 | 30 | 13 | 29 |
| 763 | 6 | 20 | 6 |
| 764 | 13 | 27 | 13 |

FIG. 7

| WEEK NUMBER | A | B | C |
|---|---|---|---|
| 765 | 20 | 4 | 20 |
| 766 | 27 | 11 | 27 |
| 767 | 4 | 18 | 3 |
| 768 | 11 | 25 | 10 |
| 769 | 18 | 1 | 17 |
| 770 | 25 | 8 | 24 |
| 771 | 1 | 15 | 31 |
| 772 | 8 | 22 | 7 |
| 773 | 15 | 29 | 14 |
| 774 | 22 | 5 | 21 |
| 775 | 29 | 12 | 28 |
| 776 | 6 | 19 | 5 |
| 777 | 13 | 26 | 12 |
| 778 | 20 | 5 | 19 |
| 779 | 27 | 12 | 26 |
| 780 | 3 | 19 | 2 |
| 781 | 10 | 26 | 9 |
| 782 | 17 | 2 | 16 |
| 783 | 24 | 9 | 23 |
| 784 | 31 | 16 | 30 |
| 785 | 7 | 23 | 7 |
| 786 | 14 | 30 | 14 |
| 787 | 21 | 7 | 21 |
| 788 | 28 | 14 | 28 |
| 789 | 5 | 21 | 4 |
| 790 | 12 | 28 | 11 |
| 791 | 19 | 4 | 18 |
| 792 | 26 | 11 | 25 |
| 793 | 2 | 18 | 1 |
| 794 | 9 | 25 | 8 |
| 795 | 16 | 2 | 15 |
| 796 | 23 | 9 | 22 |
| 797 | 30 | 16 | 1 |
| 798 | 7 | 23 | 8 |
| 799 | 14 | 30 | 15 |
| 800 | 21 | 6 | 22 |
| 801 | 28 | 13 | 29 |
| 802 | 4 | 20 | 5 |
| 803 | 11 | 27 | 12 |
| 804 | 18 | 3 | 19 |

| WEEK NUMBER | A | B | C |
|---|---|---|---|
| 805 | 25 | 10 | 26 |
| 806 | 1 | 17 | 3 |
| 807 | 8 | 24 | 10 |
| 808 | 15 | 1 | 17 |
| 809 | 22 | 8 | 24 |
| 810 | 1 | 15 | 31 |
| 811 | 8 | 22 | 7 |
| 812 | 15 | 29 | 14 |
| 813 | 22 | 5 | 21 |
| 814 | 29 | 12 | 28 |
| 815 | 5 | 19 | 5 |
| 816 | 12 | 26 | 12 |
| 817 | 19 | 3 | 19 |
| 818 | 26 | 10 | 26 |
| 819 | 3 | 17 | 2 |
| 820 | 10 | 24 | 9 |
| 821 | 17 | 31 | 16 |
| 822 | 24 | 7 | 23 |
| 823 | 31 | 14 | 30 |
| 824 | 7 | 21 | 6 |
| 825 | 14 | 28 | 13 |
| 826 | 21 | 4 | 20 |
| 827 | 28 | 11 | 27 |
| 828 | 5 | 18 | 4 |
| 829 | 12 | 25 | 11 |
| 830 | 19 | 4 | 18 |
| 831 | 26 | 11 | 25 |
| 832 | 2 | 18 | 1 |
| 833 | 9 | 25 | 8 |
| 834 | 16 | 1 | 15 |
| 835 | 23 | 8 | 22 |
| 836 | 30 | 15 | 29 |
| 837 | 6 | 22 | 6 |
| 838 | 13 | 29 | 13 |
| 839 | 20 | 6 | 20 |
| 840 | 27 | 13 | 27 |
| 841 | 4 | 20 | 3 |
| 842 | 11 | 27 | 10 |
| 843 | 18 | 3 | 17 |
| 844 | 25 | 10 | 24 |

| WEEK NUMBER | A | B | C |
|---|---|---|---|
| 845 | 1 | 17 | 31 |
| 846 | 8 | 24 | 7 |
| 847 | 15 | 1 | 14 |
| 848 | 22 | 8 | 21 |
| 849 | 29 | 15 | 28 |
| 850 | 6 | 22 | 7 |
| 851 | 13 | 29 | 14 |
| 852 | 20 | 5 | 21 |
| 853 | 27 | 12 | 28 |
| 854 | 3 | 19 | 4 |
| 855 | 10 | 26 | 11 |
| 856 | 17 | 2 | 18 |
| 857 | 24 | 9 | 25 |
| 858 | 31 | 16 | 2 |
| 859 | 7 | 23 | 9 |
| 860 | 14 | 30 | 16 |
| 861 | 21 | 7 | 23 |
| 862 | 28 | 14 | 30 |
| 863 | 6 | 21 | 6 |
| 864 | 13 | 28 | 13 |
| 865 | 20 | 4 | 20 |
| 866 | 27 | 11 | 27 |
| 867 | 3 | 18 | 4 |
| 868 | 10 | 25 | 11 |
| 869 | 17 | 2 | 18 |
| 870 | 24 | 9 | 25 |
| 871 | 1 | 16 | 1 |
| 872 | 8 | 23 | 8 |
| 873 | 15 | 30 | 15 |
| 874 | 22 | 6 | 22 |
| 875 | 29 | 13 | 29 |
| 876 | 5 | 20 | 5 |
| 877 | 12 | 27 | 12 |
| 878 | 19 | 3 | 19 |
| 879 | 26 | 10 | 26 |
| 880 | 3 | 17 | 3 |
| 881 | 10 | 24 | 10 |
| 882 | 17 | 2 | 17 |
| 883 | 24 | 9 | 24 |
| 884 | 31 | 16 | 31 |

FIG. 8

| WEEK NUMBER | A | B | C |
|---|---|---|---|
| 885 | 7 | 23 | 7 |
| 886 | 14 | 30 | 14 |
| 887 | 21 | 6 | 21 |
| 888 | 28 | 13 | 28 |
| 889 | 4 | 20 | 5 |
| 890 | 11 | 27 | 12 |
| 891 | 18 | 4 | 19 |
| 892 | 25 | 11 | 26 |
| 893 | 2 | 18 | 2 |
| 894 | 9 | 25 | 9 |
| 895 | 16 | 1 | 16 |
| 896 | 23 | 8 | 23 |
| 897 | 30 | 15 | 30 |
| 898 | 6 | 22 | 6 |
| 899 | 13 | 29 | 13 |
| 900 | 20 | 6 | 20 |
| 901 | 27 | 13 | 27 |
| 902 | 4 | 20 | 5 |
| 903 | 11 | 27 | 12 |
| 904 | 18 | 3 | 19 |
| 905 | 25 | 10 | 26 |
| 906 | 1 | 17 | 2 |
| 907 | 8 | 24 | 9 |
| 908 | 15 | 31 | 16 |
| 909 | 22 | 7 | 23 |
| 910 | 29 | 14 | 30 |
| 911 | 5 | 21 | 7 |
| 912 | 12 | 28 | 14 |
| 913 | 19 | 5 | 21 |
| 914 | 26 | 12 | 28 |
| 915 | 5 | 19 | 4 |
| 916 | 12 | 26 | 11 |
| 917 | 19 | 2 | 18 |
| 918 | 26 | 9 | 25 |
| 919 | 2 | 16 | 2 |
| 920 | 9 | 23 | 9 |
| 921 | 16 | 30 | 16 |
| 922 | 23 | 7 | 23 |
| 923 | 30 | 14 | 30 |
| 924 | 7 | 21 | 6 |

| WEEK NUMBER | A | B | C |
|---|---|---|---|
| 925 | 14 | 28 | 13 |
| 926 | 21 | 4 | 20 |
| 927 | 28 | 11 | 27 |
| 928 | 4 | 18 | 3 |
| 929 | 11 | 25 | 10 |
| 930 | 18 | 1 | 17 |
| 931 | 25 | 8 | 24 |
| 932 | 2 | 15 | 1 |
| 933 | 9 | 22 | 8 |
| 934 | 16 | 1 | 15 |
| 935 | 23 | 8 | 22 |
| 936 | 30 | 15 | 29 |
| 937 | 6 | 22 | 5 |
| 938 | 13 | 29 | 12 |
| 939 | 20 | 5 | 19 |
| 940 | 27 | 12 | 26 |
| 941 | 3 | 19 | 3 |
| 942 | 10 | 26 | 10 |
| 943 | 17 | 3 | 17 |
| 944 | 24 | 10 | 24 |
| 945 | 1 | 17 | 31 |
| 946 | 8 | 24 | 7 |
| 947 | 15 | 31 | 14 |
| 948 | 22 | 7 | 21 |
| 949 | 29 | 14 | 28 |
| 950 | 5 | 21 | 4 |
| 951 | 12 | 28 | 11 |
| 952 | 19 | 5 | 18 |
| 953 | 26 | 12 | 25 |
| 954 | 3 | 19 | 4 |
| 955 | 10 | 26 | 11 |
| 956 | 17 | 2 | 18 |
| 957 | 24 | 9 | 25 |
| 958 | 31 | 16 | 1 |
| 959 | 7 | 23 | 8 |
| 960 | 14 | 30 | 15 |
| 961 | 21 | 6 | 22 |
| 962 | 28 | 13 | 29 |
| 963 | 4 | 20 | 6 |
| 964 | 11 | 27 | 13 |

| WEEK NUMBER | A | B | C |
|---|---|---|---|
| 965 | 18 | 4 | 20 |
| 966 | 25 | 11 | 27 |
| 967 | 4 | 18 | 3 |
| 968 | 11 | 25 | 10 |
| 969 | 18 | 1 | 17 |
| 970 | 25 | 8 | 24 |
| 971 | 1 | 15 | 1 |
| 972 | 8 | 22 | 8 |
| 973 | 15 | 29 | 15 |
| 974 | 22 | 6 | 22 |
| 975 | 29 | 13 | 29 |
| 976 | 6 | 20 | 5 |
| 977 | 13 | 27 | 12 |
| 978 | 20 | 3 | 19 |
| 979 | 27 | 10 | 26 |
| 980 | 3 | 17 | 2 |
| 981 | 10 | 24 | 9 |
| 982 | 17 | 31 | 16 |
| 983 | 24 | 7 | 23 |
| 984 | 1 | 14 | 30 |
| 985 | 8 | 21 | 7 |
| 986 | 15 | 28 | 14 |
| 987 | 22 | 7 | 21 |
| 988 | 29 | 14 | 28 |
| 989 | 5 | 21 | 4 |
| 990 | 12 | 28 | 11 |
| 991 | 19 | 4 | 18 |
| 992 | 26 | 11 | 25 |
| 993 | 2 | 18 | 2 |
| 994 | 9 | 25 | 9 |
| 995 | 16 | 2 | 16 |
| 996 | 23 | 9 | 23 |
| 997 | 30 | 16 | 30 |
| 998 | 7 | 23 | 6 |
| 999 | 14 | 30 | 13 |
| 1000 | 21 | 6 | 20 |
| 1001 | 28 | 13 | 27 |
| 1002 | 4 | 20 | 3 |
| 1003 | 11 | 27 | 10 |
| 1004 | 18 | 4 | 17 |

FIG. 9

| WEEK NUMBER | A | B | C |
|---|---|---|---|
| 1005 | 25 | 11 | 24 |
| 1006 | 2 | 18 | 3 |
| 1007 | 9 | 25 | 10 |
| 1008 | 16 | 1 | 17 |
| 1009 | 23 | 8 | 24 |
| 1010 | 30 | 15 | 31 |
| 1011 | 6 | 22 | 7 |
| 1012 | 13 | 29 | 14 |
| 1013 | 20 | 5 | 21 |
| 1014 | 27 | 12 | 28 |
| 1015 | 3 | 19 | 5 |
| 1016 | 10 | 26 | 12 |
| 1017 | 17 | 3 | 19 |
| 1018 | 24 | 10 | 26 |
| 1019 | 3 | 17 | 2 |
| 1020 | 10 | 24 | 9 |
| 1021 | 17 | 31 | 16 |
| 1022 | 24 | 7 | 23 |
| 1023 | 31 | 14 | 30 |
| 0 | 7 | 21 | 7 |
| 1 | 14 | 28 | 14 |
| 2 | 21 | 5 | 21 |
| 3 | 28 | 12 | 28 |
| 4 | 5 | 19 | 4 |
| 5 | 12 | 26 | 11 |
| 6 | 19 | 2 | 18 |
| 7 | 26 | 9 | 25 |
| 8 | 2 | 16 | 1 |
| 9 | 9 | 23 | 8 |
| 10 | 16 | 30 | 15 |
| 11 | 23 | 6 | 22 |
| 12 | 30 | 13 | 29 |
| 13 | 7 | 20 | 6 |
| 14 | 14 | 27 | 13 |
| 15 | 21 | 6 | 20 |
| 16 | 28 | 13 | 27 |
| 17 | 4 | 20 | 3 |
| 18 | 11 | 27 | 10 |
| 19 | 18 | 3 | 17 |
| 20 | 25 | 10 | 24 |

| WEEK NUMBER | A | B | C |
|---|---|---|---|
| 21 | 1 | 17 | 1 |
| 22 | 8 | 24 | 8 |
| 23 | 15 | 1 | 15 |
| 24 | 22 | 8 | 22 |
| 25 | 29 | 15 | 29 |
| 26 | 6 | 22 | 5 |
| 27 | 13 | 29 | 12 |
| 28 | 20 | 5 | 19 |
| 29 | 27 | 12 | 26 |
| 30 | 3 | 19 | 2 |
| 31 | 10 | 26 | 9 |
| 32 | 17 | 3 | 16 |
| 33 | 24 | 10 | 23 |
| 34 | 1 | 17 | 2 |
| 35 | 8 | 24 | 9 |
| 36 | 15 | 31 | 16 |
| 37 | 22 | 7 | 23 |
| 38 | 29 | 14 | 30 |
| 39 | 5 | 21 | 6 |
| 40 | 12 | 28 | 13 |
| 41 | 19 | 4 | 20 |
| 42 | 26 | 11 | 27 |
| 43 | 2 | 18 | 4 |
| 44 | 9 | 25 | 11 |
| 45 | 16 | 2 | 18 |
| 46 | 23 | 9 | 25 |
| 47 | 1 | 16 | 1 |
| 48 | 8 | 23 | 8 |
| 49 | 15 | 30 | 15 |
| 50 | 22 | 6 | 22 |
| 51 | 29 | 13 | 29 |
| 52 | 5 | 20 | 6 |
| 53 | 12 | 27 | 13 |
| 54 | 19 | 4 | 20 |
| 55 | 26 | 11 | 27 |
| 56 | 3 | 18 | 3 |
| 57 | 10 | 25 | 10 |
| 58 | 17 | 1 | 17 |
| 59 | 24 | 8 | 24 |
| 60 | 31 | 15 | 31 |

| WEEK NUMBER | A | B | C |
|---|---|---|---|
| 61 | 7 | 22 | 7 |
| 62 | 14 | 29 | 14 |
| 63 | 21 | 5 | 21 |
| 64 | 28 | 12 | 28 |
| 65 | 5 | 19 | 5 |
| 66 | 12 | 26 | 12 |
| 67 | 19 | 4 | 19 |
| 68 | 26 | 11 | 26 |
| 69 | 2 | 18 | 2 |
| 70 | 9 | 25 | 9 |
| 71 | 16 | 1 | 16 |
| 72 | 23 | 8 | 23 |
| 73 | 30 | 15 | 30 |
| 74 | 6 | 22 | 7 |
| 75 | 13 | 29 | 14 |
| 76 | 20 | 6 | 21 |
| 77 | 27 | 13 | 28 |
| 78 | 4 | 20 | 4 |
| 79 | 11 | 27 | 11 |
| 80 | 18 | 3 | 18 |
| 81 | 25 | 10 | 25 |
| 82 | 1 | 17 | 1 |
| 83 | 8 | 24 | 8 |
| 84 | 15 | 1 | 15 |
| 85 | 22 | 8 | 22 |
| 86 | 29 | 15 | 29 |
| 87 | 6 | 22 | 7 |
| 88 | 13 | 29 | 14 |
| 89 | 20 | 5 | 21 |
| 90 | 27 | 12 | 28 |
| 91 | 3 | 19 | 4 |
| 92 | 10 | 26 | 11 |
| 93 | 17 | 2 | 18 |
| 94 | 24 | 9 | 25 |
| 95 | 31 | 16 | 2 |
| 96 | 7 | 23 | 9 |
| 97 | 14 | 30 | 16 |
| 98 | 21 | 7 | 23 |
| 99 | 28 | 14 | 30 |
| 100 | 7 | 21 | 6 |

FIG.10

| WEEK NUMBER | A | B | C |
|---|---|---|---|
| 101 | 14 | 28 | 13 |
| 102 | 21 | 4 | 20 |
| 103 | 28 | 11 | 27 |
| 104 | 4 | 18 | 4 |
| 105 | 11 | 25 | 11 |
| 106 | 18 | 2 | 18 |
| 107 | 25 | 9 | 25 |
| 108 | 2 | 16 | 1 |
| 109 | 9 | 23 | 8 |
| 110 | 16 | 30 | 15 |
| 111 | 23 | 6 | 22 |
| 112 | 30 | 13 | 29 |
| 113 | 6 | 20 | 5 |
| 114 | 13 | 27 | 12 |
| 115 | 20 | 3 | 19 |
| 116 | 27 | 10 | 26 |
| 117 | 4 | 17 | 3 |
| 118 | 11 | 24 | 10 |
| 119 | 18 | 3 | 17 |
| 120 | 25 | 10 | 24 |
| 121 | 1 | 17 | 31 |
| 122 | 8 | 24 | 7 |
| 123 | 15 | 31 | 14 |
| 124 | 22 | 7 | 21 |
| 125 | 29 | 14 | 28 |
| 126 | 5 | 21 | 5 |
| 127 | 12 | 28 | 12 |
| 128 | 19 | 5 | 19 |
| 129 | 26 | 12 | 26 |
| 130 | 3 | 19 | 2 |
| 131 | 10 | 26 | 9 |
| 132 | 17 | 2 | 16 |
| 133 | 24 | 9 | 23 |
| 134 | 31 | 16 | 30 |
| 135 | 7 | 23 | 6 |
| 136 | 14 | 30 | 13 |
| 137 | 21 | 7 | 20 |
| 138 | 28 | 14 | 27 |
| 139 | 5 | 21 | 6 |
| 140 | 12 | 28 | 13 |

| WEEK NUMBER | A | B | C |
|---|---|---|---|
| 141 | 19 | 4 | 20 |
| 142 | 26 | 11 | 27 |
| 143 | 2 | 18 | 3 |
| 144 | 9 | 25 | 10 |
| 145 | 16 | 1 | 17 |
| 146 | 23 | 8 | 24 |
| 147 | 30 | 15 | 1 |
| 148 | 6 | 22 | 8 |
| 149 | 13 | 29 | 15 |
| 150 | 20 | 6 | 22 |
| 151 | 27 | 13 | 29 |
| 152 | 6 | 20 | 5 |
| 153 | 13 | 27 | 12 |
| 154 | 20 | 3 | 19 |
| 155 | 27 | 10 | 26 |
| 156 | 3 | 17 | 3 |
| 157 | 10 | 24 | 10 |
| 158 | 17 | 1 | 17 |
| 159 | 24 | 8 | 24 |
| 160 | 1 | 15 | 31 |
| 161 | 8 | 22 | 7 |
| 162 | 15 | 29 | 14 |
| 163 | 22 | 5 | 21 |
| 164 | 29 | 12 | 28 |
| 165 | 5 | 19 | 4 |
| 166 | 12 | 26 | 11 |
| 167 | 19 | 2 | 18 |
| 168 | 26 | 9 | 25 |
| 169 | 3 | 16 | 2 |
| 170 | 10 | 23 | 9 |
| 171 | 17 | 2 | 16 |
| 172 | 24 | 9 | 23 |
| 173 | 31 | 16 | 30 |
| 174 | 7 | 23 | 6 |
| 175 | 14 | 30 | 13 |
| 176 | 21 | 6 | 20 |
| 177 | 28 | 13 | 27 |
| 178 | 4 | 20 | 4 |
| 179 | 11 | 27 | 11 |
| 180 | 18 | 4 | 18 |

| WEEK NUMBER | A | B | C |
|---|---|---|---|
| 181 | 25 | 11 | 25 |
| 182 | 2 | 18 | 1 |
| 183 | 9 | 25 | 8 |
| 184 | 16 | 1 | 15 |
| 185 | 23 | 8 | 22 |
| 186 | 30 | 15 | 29 |
| 187 | 6 | 22 | 5 |
| 188 | 13 | 29 | 12 |
| 189 | 20 | 6 | 19 |
| 190 | 27 | 13 | 26 |
| 191 | 4 | 20 | 5 |
| 192 | 11 | 27 | 12 |
| 193 | 18 | 3 | 19 |
| 194 | 25 | 10 | 26 |
| 195 | 1 | 17 | 2 |
| 196 | 8 | 24 | 9 |
| 197 | 15 | 31 | 16 |
| 198 | 22 | 7 | 23 |
| 199 | 29 | 14 | 30 |
| 200 | 5 | 21 | 7 |
| 201 | 12 | 28 | 14 |
| 202 | 19 | 5 | 21 |
| 203 | 26 | 12 | 28 |
| 204 | 5 | 19 | 4 |
| 205 | 12 | 26 | 11 |
| 206 | 19 | 2 | 18 |
| 207 | 26 | 9 | 25 |
| 208 | 2 | 16 | 2 |
| 209 | 9 | 23 | 9 |
| 210 | 16 | 30 | 16 |
| 211 | 23 | 7 | 23 |
| 212 | 30 | 14 | 30 |
| 213 | 7 | 21 | 6 |
| 214 | 14 | 28 | 13 |
| 215 | 21 | 4 | 20 |
| 216 | 28 | 11 | 27 |
| 217 | 4 | 18 | 3 |
| 218 | 11 | 25 | 10 |
| 219 | 18 | 1 | 17 |
| 220 | 25 | 8 | 24 |

FIG.11

| WEEK NUMBER | A | B | C |
|---|---|---|---|
| 221 | 2 | 15 | 1 |
| 222 | 9 | 22 | 8 |
| 223 | 16 | 1 | 15 |
| 224 | 23 | 8 | 22 |
| 225 | 30 | 15 | 29 |
| 226 | 6 | 22 | 5 |
| 227 | 13 | 29 | 12 |
| 228 | 20 | 5 | 19 |
| 229 | 27 | 12 | 26 |
| 230 | 3 | 19 | 3 |
| 231 | 10 | 26 | 10 |
| 232 | 17 | 3 | 17 |
| 233 | 24 | 10 | 24 |
| 234 | 1 | 17 | 31 |
| 235 | 8 | 24 | 7 |
| 236 | 15 | 31 | 14 |
| 237 | 22 | 7 | 21 |
| 238 | 29 | 14 | 28 |
| 239 | 5 | 21 | 4 |
| 240 | 12 | 28 | 11 |
| 241 | 19 | 5 | 18 |
| 242 | 26 | 12 | 25 |
| 243 | 3 | 19 | 4 |
| 244 | 10 | 26 | 11 |
| 245 | 17 | 2 | 18 |
| 246 | 24 | 9 | 25 |
| 247 | 31 | 16 | 1 |
| 248 | 7 | 23 | 8 |
| 249 | 14 | 30 | 15 |
| 250 | 21 | 6 | 22 |
| 251 | 28 | 13 | 29 |
| 252 | 4 | 20 | 6 |
| 253 | 11 | 27 | 13 |
| 254 | 18 | 4 | 20 |
| 255 | 25 | 11 | 27 |
| 256 | 3 | 18 | 3 |
| 257 | 10 | 25 | 10 |
| 258 | 17 | 1 | 17 |
| 259 | 24 | 8 | 24 |
| 260 | 31 | 15 | 1 |

| WEEK NUMBER | A | B | C |
|---|---|---|---|
| 261 | 7 | 22 | 8 |
| 262 | 14 | 29 | 15 |
| 263 | 21 | 6 | 22 |
| 264 | 28 | 13 | 29 |
| 265 | 5 | 20 | 5 |
| 266 | 12 | 27 | 12 |
| 267 | 19 | 3 | 19 |
| 268 | 26 | 10 | 26 |
| 269 | 2 | 17 | 2 |
| 270 | 9 | 24 | 9 |
| 271 | 16 | 31 | 16 |
| 272 | 23 | 7 | 23 |
| 273 | 30 | 14 | 30 |
| 274 | 7 | 21 | 7 |
| 275 | 14 | 28 | 14 |
| 276 | 21 | 6 | 21 |
| 277 | 28 | 13 | 28 |
| 278 | 4 | 20 | 4 |
| 279 | 11 | 27 | 11 |
| 280 | 18 | 3 | 18 |
| 281 | 25 | 10 | 25 |
| 282 | 1 | 17 | 2 |
| 283 | 8 | 24 | 9 |
| 284 | 15 | 1 | 16 |
| 285 | 22 | 8 | 23 |
| 286 | 29 | 15 | 30 |
| 287 | 6 | 22 | 6 |
| 288 | 13 | 29 | 13 |
| 289 | 20 | 5 | 20 |
| 290 | 27 | 12 | 27 |
| 291 | 3 | 19 | 3 |
| 292 | 10 | 26 | 10 |
| 293 | 17 | 3 | 17 |
| 294 | 24 | 10 | 24 |
| 295 | 1 | 17 | 2 |
| 296 | 8 | 24 | 9 |
| 297 | 15 | 31 | 16 |
| 298 | 22 | 7 | 23 |
| 299 | 29 | 14 | 30 |
| 300 | 5 | 21 | 6 |

| WEEK NUMBER | A | B | C |
|---|---|---|---|
| 301 | 12 | 28 | 13 |
| 302 | 19 | 4 | 20 |
| 303 | 26 | 11 | 27 |
| 304 | 2 | 18 | 4 |
| 305 | 9 | 25 | 11 |
| 306 | 16 | 2 | 18 |
| 307 | 23 | 9 | 25 |
| 308 | 2 | 16 | 1 |
| 309 | 9 | 23 | 8 |
| 310 | 16 | 30 | 15 |
| 311 | 23 | 6 | 22 |
| 312 | 30 | 13 | 29 |
| 313 | 6 | 20 | 6 |
| 314 | 13 | 27 | 13 |
| 315 | 20 | 4 | 20 |
| 316 | 27 | 11 | 27 |
| 317 | 4 | 18 | 3 |
| 318 | 11 | 25 | 10 |
| 319 | 18 | 1 | 17 |
| 320 | 25 | 8 | 24 |
| 321 | 1 | 15 | 31 |
| 322 | 8 | 22 | 7 |
| 323 | 15 | 29 | 14 |
| 324 | 22 | 5 | 21 |
| 325 | 29 | 12 | 28 |
| 326 | 6 | 19 | 5 |
| 327 | 13 | 26 | 12 |
| 328 | 20 | 5 | 19 |
| 329 | 27 | 12 | 26 |
| 330 | 3 | 19 | 2 |
| 331 | 10 | 26 | 9 |
| 332 | 17 | 2 | 16 |
| 333 | 24 | 9 | 23 |
| 334 | 31 | 16 | 30 |
| 335 | 7 | 23 | 7 |
| 336 | 14 | 30 | 14 |
| 337 | 21 | 7 | 21 |
| 338 | 28 | 14 | 28 |
| 339 | 5 | 21 | 4 |
| 340 | 12 | 28 | 11 |

FIG.12

| WEEK NUMBER | A | B | C |
|---|---|---|---|
| 341 | 19 | 4 | 18 |
| 342 | 26 | 11 | 25 |
| 343 | 2 | 18 | 1 |
| 344 | 9 | 25 | 8 |
| 345 | 16 | 2 | 15 |
| 346 | 23 | 9 | 22 |
| 347 | 30 | 16 | 1 |
| 348 | 7 | 23 | 8 |
| 349 | 14 | 30 | 15 |
| 350 | 21 | 6 | 22 |
| 351 | 28 | 13 | 29 |
| 352 | 4 | 20 | 5 |
| 353 | 11 | 27 | 12 |
| 354 | 18 | 3 | 19 |
| 355 | 25 | 10 | 26 |
| 356 | 1 | 17 | 3 |
| 357 | 8 | 24 | 10 |
| 358 | 15 | 1 | 17 |
| 359 | 22 | 8 | 24 |
| 360 | 1 | 15 | 31 |
| 361 | 8 | 22 | 7 |
| 362 | 15 | 29 | 14 |
| 363 | 22 | 5 | 21 |
| 364 | 29 | 12 | 28 |
| 365 | 5 | 19 | 5 |
| 366 | 12 | 26 | 12 |
| 367 | 19 | 3 | 19 |
| 368 | 26 | 10 | 26 |
| 369 | 3 | 17 | 2 |
| 370 | 10 | 24 | 9 |
| 371 | 17 | 31 | 16 |
| 372 | 24 | 7 | 23 |
| 373 | 31 | 14 | 30 |
| 374 | 7 | 21 | 6 |
| 375 | 14 | 28 | 13 |
| 376 | 21 | 4 | 20 |
| 377 | 28 | 11 | 27 |
| 378 | 5 | 18 | 4 |
| 379 | 12 | 25 | 11 |
| 380 | 19 | 4 | 18 |

| WEEK NUMBER | A | B | C |
|---|---|---|---|
| 381 | 26 | 11 | 25 |
| 382 | 2 | 18 | 1 |
| 383 | 9 | 25 | 8 |
| 384 | 16 | 1 | 15 |
| 385 | 23 | 8 | 22 |
| 386 | 30 | 15 | 29 |
| 387 | 6 | 22 | 6 |
| 388 | 13 | 29 | 13 |
| 389 | 20 | 6 | 20 |
| 390 | 27 | 13 | 27 |
| 391 | 4 | 20 | 3 |
| 392 | 11 | 27 | 10 |
| 393 | 18 | 3 | 17 |
| 394 | 25 | 10 | 24 |
| 395 | 1 | 17 | 31 |
| 396 | 8 | 24 | 7 |
| 397 | 15 | 1 | 14 |
| 398 | 22 | 8 | 21 |
| 399 | 29 | 15 | 28 |
| 400 | 6 | 22 | 7 |
| 401 | 13 | 29 | 14 |
| 402 | 20 | 5 | 21 |
| 403 | 27 | 12 | 28 |
| 404 | 3 | 19 | 4 |
| 405 | 10 | 26 | 11 |
| 406 | 17 | 2 | 18 |
| 407 | 24 | 9 | 25 |
| 408 | 31 | 16 | 2 |
| 409 | 7 | 23 | 9 |
| 410 | 14 | 30 | 16 |
| 411 | 21 | 7 | 23 |
| 412 | 28 | 14 | 30 |
| 413 | 7 | 21 | 6 |
| 414 | 14 | 28 | 13 |
| 415 | 21 | 4 | 20 |
| 416 | 28 | 11 | 27 |
| 417 | 4 | 18 | 4 |
| 418 | 11 | 25 | 11 |
| 419 | 18 | 2 | 18 |
| 420 | 25 | 9 | 25 |

| WEEK NUMBER | A | B | C |
|---|---|---|---|
| 421 | 2 | 16 | 1 |
| 422 | 9 | 23 | 8 |
| 423 | 16 | 30 | 15 |
| 424 | 23 | 6 | 22 |
| 425 | 30 | 13 | 29 |
| 426 | 6 | 20 | 5 |
| 427 | 13 | 27 | 12 |
| 428 | 20 | 3 | 19 |
| 429 | 27 | 10 | 26 |
| 430 | 4 | 17 | 3 |
| 431 | 11 | 24 | 10 |
| 432 | 18 | 3 | 17 |
| 433 | 25 | 10 | 24 |
| 434 | 1 | 17 | 31 |
| 435 | 8 | 24 | 7 |
| 436 | 15 | 31 | 14 |
| 437 | 22 | 7 | 21 |
| 438 | 29 | 14 | 28 |
| 439 | 5 | 21 | 5 |
| 440 | 12 | 28 | 12 |
| 441 | 19 | 5 | 19 |
| 442 | 26 | 12 | 26 |
| 443 | 3 | 19 | 2 |
| 444 | 10 | 26 | 9 |
| 445 | 17 | 2 | 16 |
| 446 | 24 | 9 | 23 |
| 447 | 31 | 16 | 30 |
| 448 | 7 | 23 | 6 |
| 449 | 14 | 30 | 13 |
| 450 | 21 | 7 | 20 |
| 451 | 28 | 14 | 27 |
| 452 | 5 | 21 | 6 |
| 453 | 12 | 28 | 13 |
| 454 | 19 | 4 | 20 |
| 455 | 26 | 11 | 27 |
| 456 | 2 | 18 | 3 |
| 457 | 9 | 25 | 10 |
| 458 | 16 | 1 | 17 |
| 459 | 23 | 8 | 24 |
| 460 | 30 | 15 | 1 |

FIG.13

| WEEK NUMBER | A | B | C |
|---|---|---|---|
| 461 | 6 | 22 | 8 |
| 462 | 13 | 29 | 15 |
| 463 | 20 | 6 | 22 |
| 464 | 27 | 13 | 29 |
| 465 | 5 | 20 | 5 |
| 466 | 12 | 27 | 12 |
| 467 | 19 | 3 | 19 |
| 468 | 26 | 10 | 26 |
| 469 | 2 | 17 | 3 |
| 470 | 9 | 24 | 10 |
| 471 | 16 | 1 | 17 |
| 472 | 23 | 8 | 24 |
| 473 | 30 | 15 | 31 |
| 474 | 7 | 22 | 7 |
| 475 | 14 | 29 | 14 |
| 476 | 21 | 5 | 21 |
| 477 | 28 | 12 | 28 |
| 478 | 4 | 19 | 4 |
| 479 | 11 | 26 | 11 |
| 480 | 18 | 2 | 18 |
| 481 | 25 | 9 | 25 |
| 482 | 2 | 16 | 2 |
| 483 | 9 | 23 | 9 |
| 484 | 16 | 1 | 16 |
| 485 | 23 | 8 | 23 |
| 486 | 30 | 15 | 30 |
| 487 | 6 | 22 | 6 |
| 488 | 13 | 29 | 13 |
| 489 | 20 | 5 | 20 |
| 490 | 27 | 12 | 27 |
| 491 | 3 | 19 | 4 |
| 492 | 10 | 26 | 11 |
| 493 | 17 | 3 | 18 |
| 494 | 24 | 10 | 25 |
| 495 | 1 | 17 | 1 |
| 496 | 8 | 24 | 8 |
| 497 | 15 | 31 | 15 |
| 498 | 22 | 7 | 22 |
| 499 | 29 | 14 | 29 |
| 500 | 5 | 21 | 5 |

| WEEK NUMBER | A | B | C |
|---|---|---|---|
| 501 | 12 | 28 | 12 |
| 502 | 19 | 5 | 19 |
| 503 | 26 | 12 | 26 |
| 504 | 3 | 19 | 4 |
| 505 | 10 | 26 | 11 |
| 506 | 17 | 2 | 18 |
| 507 | 24 | 9 | 25 |
| 508 | 31 | 16 | 1 |
| 509 | 7 | 23 | 8 |
| 510 | 14 | 30 | 15 |
| 511 | 21 | 6 | 22 |
| 512 | 28 | 13 | 29 |
| 513 | 4 | 20 | 6 |
| 514 | 11 | 27 | 13 |
| 515 | 18 | 4 | 20 |
| 516 | 25 | 11 | 27 |
| 517 | 4 | 18 | 3 |
| 518 | 11 | 25 | 10 |
| 519 | 18 | 1 | 17 |
| 520 | 25 | 8 | 24 |
| 521 | 1 | 15 | 1 |
| 522 | 8 | 22 | 8 |
| 523 | 15 | 29 | 15 |
| 524 | 22 | 6 | 22 |
| 525 | 29 | 13 | 29 |
| 526 | 6 | 20 | 5 |
| 527 | 13 | 27 | 12 |
| 528 | 20 | 3 | 19 |
| 529 | 27 | 10 | 26 |
| 530 | 3 | 17 | 2 |
| 531 | 10 | 24 | 9 |
| 532 | 17 | 31 | 16 |
| 533 | 24 | 7 | 23 |
| 534 | 1 | 14 | 30 |
| 535 | 8 | 21 | 7 |
| 536 | 15 | 28 | 14 |
| 537 | 22 | 7 | 21 |
| 538 | 29 | 14 | 28 |
| 539 | 5 | 21 | 4 |
| 540 | 12 | 28 | 11 |

| WEEK NUMBER | A | B | C |
|---|---|---|---|
| 541 | 19 | 4 | 18 |
| 542 | 26 | 11 | 25 |
| 543 | 2 | 18 | 2 |
| 544 | 9 | 25 | 9 |
| 545 | 16 | 2 | 16 |
| 546 | 23 | 9 | 23 |
| 547 | 30 | 16 | 30 |
| 548 | 7 | 23 | 6 |
| 549 | 14 | 30 | 13 |
| 550 | 21 | 6 | 20 |
| 551 | 28 | 13 | 27 |
| 552 | 4 | 20 | 3 |
| 553 | 11 | 27 | 10 |
| 554 | 18 | 4 | 17 |
| 555 | 25 | 11 | 24 |
| 556 | 2 | 18 | 3 |
| 557 | 9 | 25 | 10 |
| 558 | 16 | 1 | 17 |
| 559 | 23 | 8 | 24 |
| 560 | 30 | 15 | 31 |
| 561 | 6 | 22 | 7 |
| 562 | 13 | 29 | 14 |
| 563 | 20 | 5 | 21 |
| 564 | 27 | 12 | 28 |
| 565 | 3 | 19 | 5 |
| 566 | 10 | 26 | 12 |
| 567 | 17 | 3 | 19 |
| 568 | 24 | 10 | 26 |
| 569 | 3 | 17 | 2 |
| 570 | 10 | 24 | 9 |
| 571 | 17 | 31 | 16 |
| 572 | 24 | 7 | 23 |
| 573 | 31 | 14 | 30 |
| 574 | 7 | 21 | 7 |
| 575 | 14 | 28 | 14 |
| 576 | 21 | 5 | 21 |
| 577 | 28 | 12 | 28 |
| 578 | 5 | 19 | 4 |
| 579 | 12 | 26 | 11 |
| 580 | 19 | 2 | 18 |

FIG.14

| WEEK NUMBER | A | B | C |
|---|---|---|---|
| 581 | 26 | 9 | 25 |
| 582 | 2 | 16 | 1 |
| 583 | 9 | 23 | 8 |
| 584 | 16 | 30 | 15 |
| 585 | 23 | 6 | 22 |
| 586 | 30 | 13 | 29 |
| 587 | 7 | 20 | 6 |
| 588 | 14 | 27 | 13 |
| 589 | 21 | 6 | 20 |
| 590 | 28 | 13 | 27 |
| 591 | 4 | 20 | 3 |
| 592 | 11 | 27 | 10 |
| 593 | 18 | 3 | 17 |
| 594 | 25 | 10 | 24 |
| 595 | 1 | 17 | 1 |
| 596 | 8 | 24 | 8 |
| 597 | 15 | 1 | 15 |
| 598 | 22 | 8 | 22 |
| 599 | 29 | 15 | 29 |
| 600 | 6 | 22 | 5 |
| 601 | 13 | 29 | 12 |
| 602 | 20 | 5 | 19 |
| 603 | 27 | 12 | 26 |
| 604 | 3 | 19 | 2 |
| 605 | 10 | 26 | 9 |
| 606 | 17 | 3 | 16 |
| 607 | 24 | 10 | 23 |
| 608 | 1 | 17 | 2 |
| 609 | 8 | 24 | 9 |
| 610 | 15 | 31 | 16 |
| 611 | 22 | 7 | 23 |
| 612 | 29 | 14 | 30 |
| 613 | 5 | 21 | 6 |
| 614 | 12 | 28 | 13 |
| 615 | 19 | 4 | 20 |
| 616 | 26 | 11 | 27 |
| 617 | 2 | 18 | 4 |
| 618 | 9 | 25 | 11 |
| 619 | 16 | 2 | 18 |
| 620 | 23 | 9 | 25 |

| WEEK NUMBER | A | B | C |
|---|---|---|---|
| 621 | 2 | 16 | 1 |
| 622 | 9 | 23 | 8 |
| 623 | 16 | 30 | 15 |
| 624 | 23 | 6 | 22 |
| 625 | 30 | 13 | 29 |
| 626 | 6 | 20 | 6 |
| 627 | 13 | 27 | 13 |
| 628 | 20 | 4 | 20 |
| 629 | 27 | 11 | 27 |
| 630 | 4 | 18 | 3 |
| 631 | 11 | 25 | 10 |
| 632 | 18 | 1 | 17 |
| 633 | 25 | 8 | 24 |
| 634 | 1 | 15 | 31 |
| 635 | 8 | 22 | 7 |
| 636 | 15 | 29 | 14 |
| 637 | 22 | 5 | 21 |
| 638 | 29 | 12 | 28 |
| 639 | 6 | 19 | 5 |
| 640 | 13 | 26 | 12 |
| 641 | 20 | 5 | 19 |
| 642 | 27 | 12 | 26 |
| 643 | 3 | 19 | 2 |
| 644 | 10 | 26 | 9 |

FIG.15

WN CYCLE TABLE

| WEEK NUMBER | A | B | C | D | E | F | G | H | I |
|---|---|---|---|---|---|---|---|---|---|
| 645 | 1 | 8 | 4 | 11 | 7 | 2 | 10 | 5 | 1 |
| 646 | 1 | 8 | 4 | 11 | 7 | 2 | 10 | 5 | 1 |
| : | : | : | : | : | : | : | : | : | : |
| 1023 | 3 | 11 | 6 | 2 | 9 | 5 | 12 | 8 | 3 |
| 0 | 4 | 11 | 7 | 2 | 10 | 5 | 1 | 8 | 4 |
| : | : | : | : | : | : | : | : | : | : |
| 644 | 8 | 3 | 11 | 6 | 2 | 9 | 5 | 12 | 8 |

FIG.18

| WEEK NUMBER | WN CYCLE TABLE | | | | | | | | |
|---|---|---|---|---|---|---|---|---|---|
| | A | B | C | D | E | F | G | H | I |
| 645 | 1 | 3 | 5 | 7 | 9 | 1 | 2 | 4 | 6 |
| 646 | 1 | 3 | 5 | 7 | 9 | 1 | 2 | 4 | 6 |
| : | : | : | : | : | : | : | : | : | : |
| 1023 | 1 | 3 | 5 | 7 | 9 | 1 | 3 | 5 | 7 |
| 0 | 1 | 3 | 5 | 7 | 9 | 1 | 3 | 5 | 7 |
| : | : | : | : | : | : | : | : | : | : |
| 644 | 3 | 5 | 7 | 9 | 1 | 2 | 4 | 6 | 8 |

FIG.22

| WEEK NUMBER | WN CYCLE TABLE | | | | | | | | |
|---|---|---|---|---|---|---|---|---|---|
| | A | B | C | D | E | F | G | H | I |
| 645 | 12 | 31 | 51 | 70 | 90 | 10 | 29 | 49 | 69 |
| 646 | 12 | 31 | 51 | 70 | 90 | 10 | 29 | 49 | 69 |
| : | : | : | : | : | : | : | : | : | : |
| 1023 | 19 | 38 | 58 | 78 | 97 | 17 | 36 | 56 | 76 |
| 0 | 19 | 38 | 58 | 78 | 97 | 17 | 37 | 56 | 76 |
| : | : | : | : | : | : | : | : | : | : |
| 644 | 31 | 51 | 70 | 90 | 10 | 29 | 49 | 68 | 88 |

FIG.25

ELECTRONIC TIMEPIECE AND TIME ADJUSTMENT METHOD FOR AN ELECTRONIC TIMEPIECE

CROSS-REFERENCE TO RELATED APPLICATIONS

Japanese Patent Application No. 2009-213224, filed Sep. 15, 2009, is hereby incorporated by reference in its entirety.

BACKGROUND

1. Field of Invention

The present invention relates to an electronic timepiece and to a time adjustment method for an electronic timepiece that receives signals transmitted from a positioning information satellites such as a GPS satellite and adjusts the time.

2. Description of Related Art

The Global Positioning System (GPS), which can be used to determine one's location, uses GPS satellites that orbit the Earth on known orbits with each GPS satellite having an on-board atomic clock. As a result, GPS satellites also transmit extremely accurate time information (referred to herein as GPS time or satellite time information).

Electronic timepieces that use time information from a GPS satellite to adjust the time kept by the timepiece are also known from the literature.

In order to acquire the necessary time information, an electronic timepiece that uses time information from a GPS satellite receives the week number WN (information identifying the week to which the current GPS time belongs), the time of the week TOW (Time of Week), and time information, also called the Z count, identifying the current day and time in the week identified by the week number in seconds counted from the beginning of each week. The accurate current time can then be calculated from the received week number and time of week information.

The week number WN is a number that started at 0:00:00 on 6 Jan. 1980 and increments 1 every week. The week number is a 10-bit digital value that therefore resets to 0 every 1024 weeks (approximately 19.7 years), a phenomenon known as week number rollover.

The current date (year, month, day) can therefore not be accurately determined using the week number WN after 1024 weeks from 6 Jan. 1980 0:00:00 h.

To solve this problem, Japanese Unexamined Patent Appl. Pub. JP-A-2001-228271, Japan Patent No. 3614713, and Japanese Unexamined Patent Appl. Pub. JP-A-2002-90441 teach timekeeping devices that acquire a reference date or other information from an external source, and calculate the accurate date based on this reference date and the week number WN and time of week TOW received from a GPS satellite.

The timekeeping device taught in JP-A-2001-228271 reads the reference date from a removable medium storing the reference date information, acquires the time by accessing the Internet, or acquires the reference date from the reference date input from a screen input device. It then converts the GPS time to a year-month-day-hour-minute-second format assuming that the GPS time is within 1024 weeks of the acquired reference date, and calculates the UTC time. As a result, the timekeeping device taught in JP-A-2001-228271 can calculate the year, month, day based on the input reference date if a new reference date is input once every 10-plus years, and can semipermanently calculate the correct date (year, month, day).

The GPS receiver taught in Japan Patent No. 3614713 calculates the WN cycle number based on a user setting or the week number WN stored on a map data storage medium. The cycle number is the number of times the 10-bit week number WN changes from 0 to 1023. If this cycle number is known, the correct date can be acquired from the acquired WN information.

The GPS receiver taught in Japanese Unexamined Patent Appl. Pub. JP-A-2002-90441 receives a standard time signal, acquires time information, recognizes the correct Gregorian calendar year using the last two digits of the Gregorian year in the time information based on the standard time signal, and can correct the time information using the recognized correct Western year number. By using the last two digits of the Gregorian year received from a standard time signal, the correct Gregorian date can be recognized for at least 100 years from the start of when the GPS system started went into service.

With the method of acquiring a reference date from a removable medium as taught in JP-A-2001-228271, however, water resistance is impaired by the need to provide a connector for inserting the removable medium, device size is increased by the size of the medium, and using this method in a wristwatch is thus difficult. In addition, when time information is acquired through Internet access, use is limited to places where there is Internet access, and where the method can be used is therefore restricted. Yet further, when the year, month, and day of the reference date is input from a screen input device, there is much information to input and ease of use is not good. Usability is particularly poor with an analog wristwatch because the hands or other device must be manipulated to input the year, month, and day.

Yet further, the method taught in JP-A-2001-228271 cannot determine the correct year, month, day if the reference date is not updated at least once within the 1024 weeks.

When the WN cycle number is set by the user as described in Japan Patent No. 3614713, the user must have knowledge of the GPS system in order to determine the current cycle number, and usability is poor. In addition, when the WN cycle number is acquired from a map information storage medium, a mechanism for reading information from the storage medium must be provided, the system configuration thus becomes complicated, and use in a small timepiece such as a wristwatch is difficult.

When time information acquired from a standard time signal is used as taught in JP-A-2002-90441, use is limited to places where a standard time signal can be acquired. Yet further, a standard time signal reception unit for receiving the standard time signals must be provided in addition to a GPS receiver, thus complicating the configuration, making reducing device size difficult, and making use in a small timepiece such as a wristwatch particularly difficult.

SUMMARY OF INVENTION

An electronic timepiece and a time adjustment method for an electronic timepiece according to the present invention enable setting information using a simple manual operation, acquiring the accurate year, month, and day, and adjusting the time even when the week number has rolled over.

A first aspect of the invention is an electronic timepiece including a receiving unit that receives satellite signals transmitted from positioning information satellites, and acquires a week number that is incremented once a week and reset after a specific cycle, and a time of week denoting the date and time in the week identified by the week number; a timekeeping unit that keeps time; an operating unit that can be manually operated by a user; a date determination information setting unit that sets a unit that is part of a date composed of year, month, and day values set using the operating unit as date determination information; a date determination unit that determines the date based on the week number, the time of week, and the date determination information; and a time adjustment unit that determines the time expressed by the current year, month, day, hour, minute, second based on the date determined by the date determination unit and the time of week, and adjusts the time kept by the timekeeping unit. When the week number indicates an n-th cycle from a specific reference date as a cycle number, the date determination information setting unit sets the date determination information using a partial unit that is a different number in each date corresponding to the same week number in a plurality of consecutive cycle numbers, and the date determination unit acquires the date in each cycle number identified by the week number and time of week based on week number cycle information correlating week numbers, cycle numbers, and dates, and determines in which of these dates the partial unit matches the date determination information.

This aspect of the invention has a date determination unit that determines the current date based on the week number WN, time of week TOW, and date determination information that is set to one unit of the date, and can therefore calculate the current time information based on the identified date and time of week.

The week number is a type of satellite signal transmitted from positioning information satellites, and is information that is incremented once a week and reset (returned to 0) after a specific cycle (1024 weeks in the GPS). For example, when the satellite signal is the L1 C/A signal, the week number is a 10-bit code that can be used to count from 0 to 1023. The week number is updated every week, and because there are approximately 52 weeks in one year, one week number cycle is 1024/52=approximately 19.7 years. Therefore, when the week number completes one cycle, the number of the next cycle is not known, and the current date and time cannot be calculated.

However, based our new discovery that one unit of the date (year, month, day) is different in each of the dates (year, month, day) for the same week number in different cycles (cycle numbers), the invention uses this partial date unit as date determination information. As a result, even if the week number is the same, the date determination unit can differentiate the dates for the same week number in each cycle if the numbers of the unit set as the date determination information are different in a range of plural consecutive cycles. The date determination unit can therefore determine the current date and calculate the current time by determining which date in the plural cycles has a partial date unit matching the date determination information.

Note that the week number cycle information (information correlating week numbers, cycle numbers, and dates) may be organized in a spreadsheet-like row and column data table that is stored in a storage unit of the timepiece, or it may be calculated when the date determination unit executes the determination process.

Furthermore, the week number WN and time of week TOW used by the date determination unit to determine the date may be acquired by the receiving unit or obtained from the time kept by the timekeeping unit. More specifically, if the reception process is executed after the date determination information is set, the week number WN and time of week TOW acquired by the receiving unit may be used. However, if the date determination information is set after the reception process executes, the week number WN and time of week TOW obtained from the time kept by the timekeeping unit after adjustment by the reception process can be used.

In an electronic timepiece according to another aspect of the invention, the date determination information setting unit preferably updates the date determination information set by the operating unit in conjunction with the unit corresponding to the date determination information in the time kept by the timekeeping unit.

This aspect of the invention can update the date determination information set by the user as time progresses by updating the date determination information manually set by the user in conjunction with the corresponding unit of the time kept by the timekeeping unit (the kept time). As a result, because the date determination information is updated in conjunction with the kept time, the same information can be used as when set on the reception date even if the day on which the user manually set the date determination information and the day on which the date is received from a satellite signal differ, the correct date can therefore be determined, and the correct time can be acquired.

In an electronic timepiece according to another aspect of the invention, the date determination information is preferably any one of a number denoting the day, a number denoting the month, a number denoting the tens digit of the Gregorian year, a two digit number including the tens digit and ones digit of the Gregorian year, and a two digit number including the hundreds and the tens digits of the Gregorian year.

The inventors have confirmed that the day, the month, the tens digit of the Gregorian year, the tens digit and ones digit of the Gregorian year, and the hundreds and tens digits of the Gregorian year, are always different in the dates of the same week number in at least two consecutive cycles. Therefore, if one of these date units is set as the date determination information, which of the dates (cycle numbers) of the same week number in at least two consecutive cycles is the current date can be determined. In addition, depending on the unit that is set as the date determination information, the date can be identified from more than just two (plural) consecutive cycles. For example, if the month is set as the date determination information, the date can be identified from among eight (plural) consecutive cycles.

In addition, if the date determination information is as described above, the numbers will be a maximum of two digits, and can be easily set manually.

Furthermore, except for the combination of the thousands and hundreds digits of the Gregorian year, the date determination information is not limited to the foregoing, and may be any combination of the date, month, one, tens, hundreds, and thousands digits of the Gregorian year, In an electronic timepiece according to another aspect of the invention, the date determination unit and the time adjustment unit preferably operate immediately after the week number and time of week are first received after the date determination information is set by the date determination information setting unit, or immediately after the date determination information is first set by the date determination information setting unit after the week number and time of week are received by the receiving unit.

In this aspect of the invention, the date determination unit and time adjustment unit can determine the current date, and determine the current time and adjust the kept time, immediately after the week number and time of week are received, or immediately after the date determination information is set. As a result, the time can be corrected using the latest information.

In an electronic timepiece according to another aspect of the invention, when a date matching the date determination information is not found, the date determination unit determines and outputs the date identified by a default cycle number that is preset in the week number cycle information, the week number, and the time of week; and the time adjustment unit determines the current time based on the date output from the date determination unit and the time of week, and adjusts the time kept by the timekeeping unit.

When a date corresponding to the date determination information set for determining the date is not found, this aspect of the invention calculates the time using the default cycle number, the week number, and the time of week. When date determination information that differs the current date is set by an operator error, for example, a date for that week number that matches the date determination information will not be found in any of the cycles, and determining the current date may not be possible. In this situation the date determination unit outputs the date identified by the default cycle number, the week number, and the time of week, and the time adjustment unit can determine the current time from this date and the time of week, and adjust the kept time.

More particularly, because the week number cycle lasts approximately 19.7 years and the date can be determined and the correct time can be set based on the default cycle number during this period, the likelihood of being able to set the correct time is high in most cases, and there is no problem with practical use.

In an electronic timepiece according to another aspect of the invention, when the week number and time of week are received when the date determination information has not been set by the date determination information setting unit, the time adjustment unit obtains the current time based on the default cycle number preset in the week number cycle information, and the received week number and time of week, and adjusts the time kept by the timekeeping unit.

This aspect of the invention can determine the time using the default cycle number and adjust the kept time when the week number and time of week are received even if the date determination information is not set.

As a result, convenience can be improved because the correct time can be automatically set while in the period corresponding to this default cycle even if the user has not set the date determination information.

In an electronic timepiece according to another aspect of the invention, when a date that matches the date determination information is found in the dates of each cycle number, the date determination unit sets the cycle number of the cycle containing the date as the default cycle number.

This aspect of the invention can set the default cycle appropriately according to the actual date and time because the cycle number of the found date is set as the default when a matching date is found. As a result, when the time is adjusted using the default cycle number, the likelihood of being able to set the correct time is increased and convenience can be improved.

In an electronic timepiece according to another aspect of the invention, when the date determination information is set by the date determination information setting unit when the week number and time of week have not been received after the electronic timepiece is initialized, the time adjustment unit preferably adjusts only the unit of the time kept by the timekeeping unit that corresponds to the set date determination information to the date determination information.

While the date cannot be determined when the week number WN and time of week TOW have not been received after initialized, this aspect of the invention corrects the corresponding unit of the kept time based on the date determination information set by the user, and can therefore update the kept time using information set by the user. For example, when the day is set as the date determination information, the day of the time kept by the timepiece can be adjusted to the set day. As a result, a different date than the date anticipated by the user will not be displayed, and usability problems can be eliminated.

The time can therefore be adjusted based on information that the user sets even when in a location where satellite signals cannot be received.

In an electronic timepiece according to another aspect of the invention, when a date that matches the date determination information is found in the dates of each cycle number, the date determination unit sets the data following that date as the search range, and thereafter when determining the date, determines the date based on data in the search range.

This aspect of the invention can set the search range to data equal to or greater than the found date, can therefore gradually shift the search range, and can thereby increase the range of years with which the timepiece is compatible.

For example, when date determination information that enables identifying dates only with the period of two consecutive cycles is used, the search range is first set to cycle numbers 1 and 2, and the current date is in the range of cycle 2, the search range used thereafter can be set to cycles 2 and 3. The search range can thus be gradually shifted and the number of years with which the timepiece can be used can be increased.

Another aspect of the invention is a time adjustment method for an electronic timepiece that has a receiving unit that receives satellite signals transmitted from positioning information satellites, and acquires a week number that is incremented once a week and reset after a specific cycle, and a time of week denoting the date and time in the week identified by the week number using time passed from a time identified by the week number, a timekeeping unit that keeps time, and an operating unit that can be manually operated by a user, the time adjustment method including: a date determination information setting step that sets a unit that is part of a date composed of year, month, and day values set using the operating unit as date determination information; a date determination step that determines the date based on the week number, the time of week, and the date determination information; and a time adjustment step that determines the time expressed by the current year, month, day, hour, minute, second based on the date determined by the date determination step and the time of week, and adjusts the time kept by the timekeeping unit. When the week number indicates an n-th cycle from a specific reference date as a cycle number, the date determination information setting step sets the date determination information using a partial unit that is a different number in each date corresponding to the same week number in a plurality of consecutive cycle numbers, and the date determination step acquires the date in each cycle number identified by the week number and time of week based on week number cycle information correlating week numbers, cycle numbers, and dates, and determines in which of these dates the partial unit matches the date determination information.

This aspect of the invention has the same operating effect as the electronic timepiece described above.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 is a table showing the correlation between week number, cycle number, and date.

FIG. 5 is a table showing the correlation between week number, WN cycle table, and date.

FIG. 6 is a table showing the correlation between week number, WN cycle table, and date.

FIG. 7 is a table showing the correlation between week number, WN cycle table, and date.

FIG. 8 is a table showing the correlation between week number, WN cycle table, and date.

FIG. 9 is a table showing the correlation between week number, WN cycle table, and date.

FIG. 10 is a table showing the correlation between week number, WN cycle table, and date.

FIG. 11 is a table showing the correlation between week number, WN cycle table, and date.

FIG. 12 is a table showing the correlation between week number, WN cycle table, and date.

FIG. 13 is a table showing the correlation between week number, WN cycle table, and date.

FIG. 14 is a table showing the correlation between week number, WN cycle table, and date.

FIG. 15 is a table showing the correlation between week number, WN cycle table, and date.

FIG. 18 is a table showing the correlation between week number, WN cycle table, and the month of the date in a second embodiment of the invention.

FIG. 22 is a table showing the correlation between week number, WN cycle table, and the decade of the date in a third embodiment of the invention.

FIG. 25 is a table showing the correlation between week number, WN cycle table, and the ones and tens digits of the year of the date in a fourth embodiment of the invention.

DESCRIPTION OF THE PREFERRED EMBODIMENTS

*Embodiment 1

A first embodiment of the invention is described next with reference to the accompanying figures.

Figure 1:
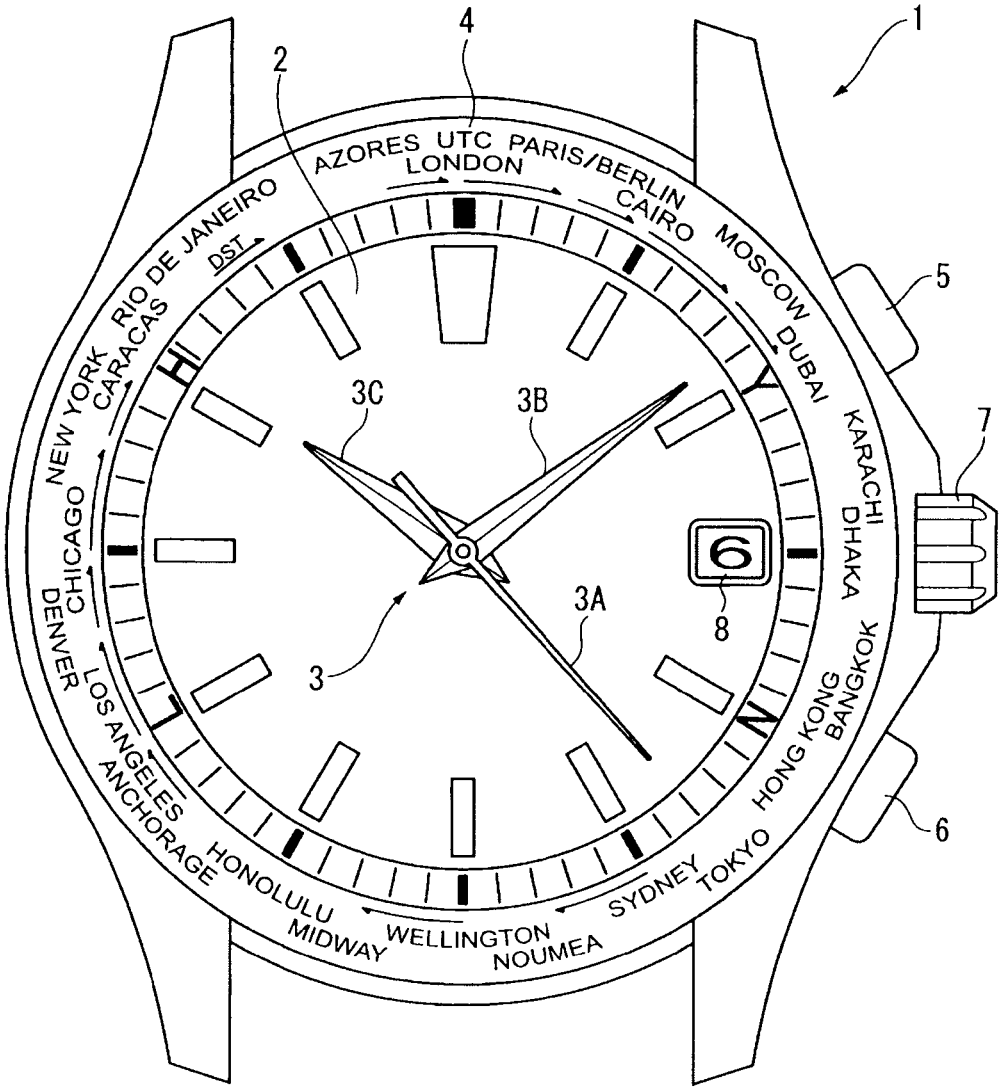
FIG. 1 is a front view of a GPS wristwatch as an example of an electronic timepiece according to the invention.
Figure 2:
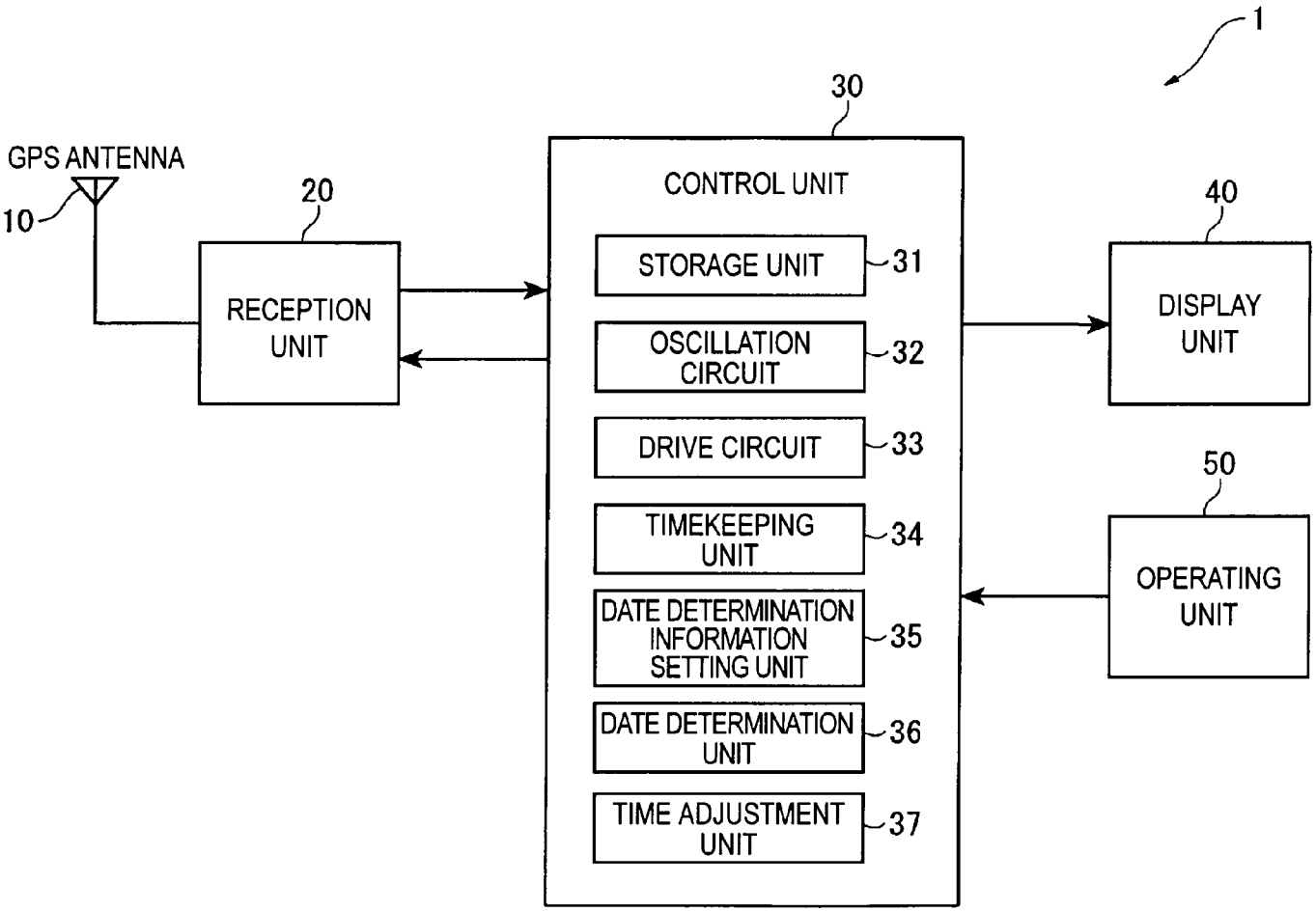
FIG. 2 is a block diagram showing the main system configuration of the GPS wristwatch shown in FIG. 1.

FIG. 1 is a front view of a wristwatch with a GPS satellite signal receiver 1 (referred to herein as a GPS wristwatch 1) according to a preferred embodiment of the invention. FIG. 2 is a block diagram showing the main system configuration of the GPS wristwatch 1.

The GPS wristwatch 1 is configured to receive satellite signals and acquire satellite time information from a plurality of GPS satellites orbiting the Earth on known orbits in space, and can correct the time kept by the GPS wristwatch 1, that is, the internal time.

Note that the GPS satellite is an example of a positioning information satellites in the invention, and a plurality of GPS satellites orbit the Earth in space. There are currently approximately 30 GPS satellites in orbit.

As shown in FIG. 1, the GPS wristwatch 1 has a time display unit including a dial 2 and hands 3.

The hands 3 include a second hand 3A, minute hand 3B, and hour hand 3C, and are driven by a stepping motor and wheel train not shown.

A button A 5, a button B 6, and a crown 7 are disposed as external operating members to the GPS wristwatch 1.

In this embodiment of the invention the GPS wristwatch 1 executes a reception process when button A 5 is depressed for several seconds (such as 3 seconds).

When the button A 5 is depressed for a shorter time (such as less than 3 seconds), the GPS wristwatch 1 displays the result of the immediately preceding reception process using the dial 2 and hands 3. For example, if reception was successful, the second hand 3A is moved to the 10-second position, and if reception failed, the second hand 3A moves to the 20-second position.

Pressing button B 6 for several seconds (such as 3 seconds) enters the time zone adjustment mode. The time zone (time difference) is set by the operation described below when in the time zone adjustment mode.

The names of cities representing different time zone candidates are presented around the bezel 4. Those cities located where daylight saving time is used are indicated by an arrow so that locations where daylight saving time is used can be easily recognized.

The time zone can be set in this GPS wristwatch 1 by setting the second hand 3A to the appropriate city name on the bezel 4. More specifically, in the time zone adjustment mode pressing button A 5 moves the second hand 3A forward one hour (+1), and pressing button B 6 moves it back one hour (−1). When the second hand 3A is set and a specific amount of time passes, the city (time zone) indicated by the second hand 3A is selected.

For example, because the time difference between UTC and Tokyo is +9 hours, the time difference to Tokyo can be selected by pressing button A 5 nine times.

Note that while the time zone is manually selected in this embodiment of the invention, positioning information can be acquired by receiving GPS satellite signals and the time zone (time difference) can be set automatically based on the positioning information.

Pulling the crown 7 out selects the date adjustment mode.

In the date adjustment mode, pressing button A 5 or button B 6 causes a disc on which the date is displayed (date wheel 8) to turn. More specifically, pressing button A 5 causes the date wheel 8 to rotate +1 day, and pressing button B 6 causes the date wheel 8 to rotate −1 day.

Note, further, that in this embodiment of the invention the date is displayed by a date wheel 8, but a LCD panel or other display device may be included to display the date digitally.

*System Configuration of a GPS Wristwatch

The system configuration of the GPS wristwatch 1 is described next.

As shown in FIG. 2, the GPS wristwatch 1 includes a GPS antenna 10, reception unit 20 (reception unit), control unit 30, display unit 40, and operating unit 50.

The display unit 40 is rendered by the hands 3 and date wheel 8 for displaying the time and the date. The operating unit 50 comprises the external operating members, that is, button A 5, button B 6, and crown 7.

*Reception Unit Configuration

The reception unit 20 acquires time information and positioning information by processing satellite signals received through the GPS antenna 10.

The GPS antenna 10 is a patch antenna, for example, for receiving satellite signals from a plurality of GPS satellites 5 orbiting the Earth on fixed orbits in space. The GPS antenna 10 is located on the back side of the dial 12, and receives RF signals through the crystal and the dial 2 of the GPS wristwatch 1.

The dial 2 and crystal are therefore made from materials that pass RF signals such as the satellite signals transmitted from the GPS satellites. The dial 2, for example, is plastic.

While not shown in the figures, the reception unit 20 primarily includes an RF (radio frequency) unit and a GPS signal processing unit. The RF unit and GPS signal processing unit execute a process that acquires satellite information such as orbit information and GPS time information carried in the navigation message decoded from 1.5 GHz satellite signals.

The RF unit is commonly used in GPS receivers including a down converter that converts high frequency signals to intermediate band signals, and an A/D converter that converts the resulting intermediate band analog signal to a digital signal.

The GPS signal processing unit includes a DSP (Digital Signal Processor), CPU (Central Processing Unit), SRAM (Static Random Access Memory), and RTC (real-time clock), decodes the navigation message from the digital signal (intermediate frequency signal) output from the RF unit, and extracts the orbit information, GPS time information, and other satellite information contained in the navigation message.

*Navigation Message

Figure 3A:
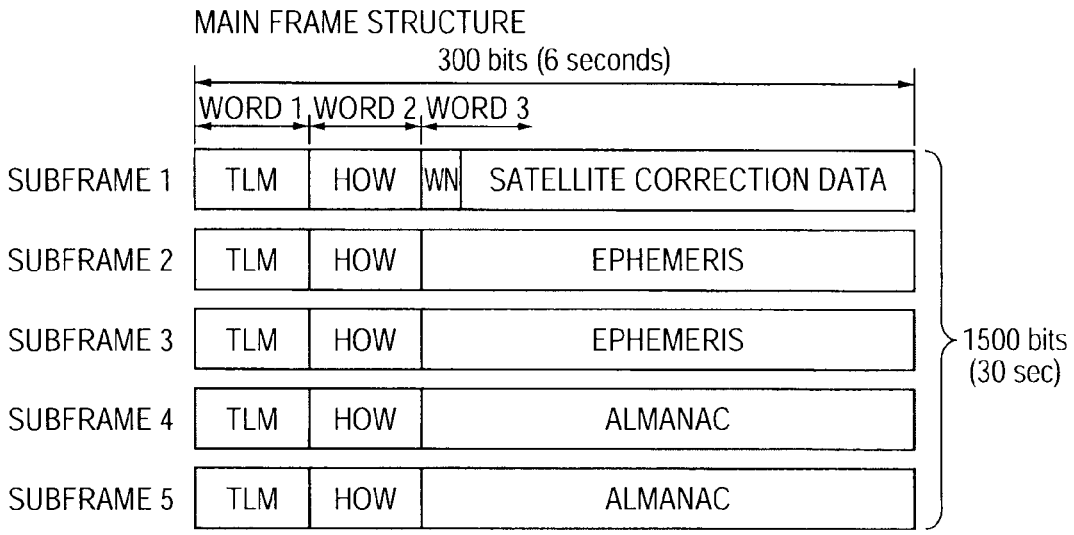
FIGS. 3A, 3B, and 3C illustrate the structure of a navigation message.
Figure 3B:
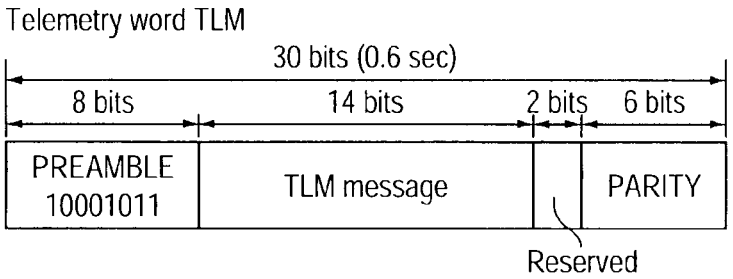
Figure 3C:
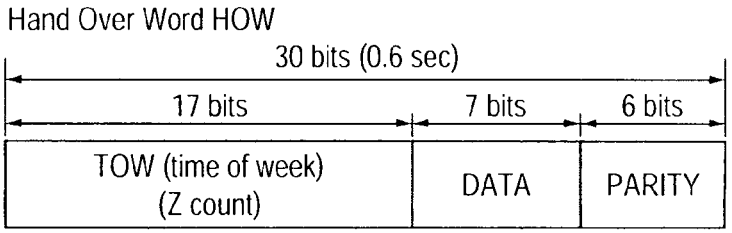

FIGS. 3A, 3B, and 3C schematically illustrate the structure of the navigation message superposed on the satellite signals.

As shown in FIG. 3A, the navigation message is composed of data organized in a single main frame containing a total 1500 bits. The main frame is divided into five subframes of 300 bits each. The data in one subframe is transmitted in 6 seconds from each GPS satellite. It therefore requires 30 seconds to transmit the data in one main frame from each GPS satellite.

Satellite correction data such as the week number WN is contained in subframe 1. The week number WN identifies the week containing the current GPS time. GPS time started at 0:00:00 on 6 Jan. 1980, and the week that started on this day has week number WN=0. The week number WN is updated every week.

Subframes 2 and 3 contain ephemeris data, that is, detailed orbit information for each GPS satellite. Subframes 4 and 5 contain almanac data (general orbit information for all GPS satellites in the constellation).

Each of subframes 1 to 5 starts with a telemetry (TLM) word containing 30 bits of telemetry (TLM) data, followed by a HOW word containing 30 bits of HOW (handover word) data. The HOW is followed by the week number WN in subframe 1.

Therefore, while the TLM words and HOW words are transmitted at 6-second intervals from the GPS satellites, the week number data and other satellite correction data, ephemeris data, and almanac data are transmitted at 30-second intervals.

As shown in FIG. 3B, the TLM word contains preamble data, a TLM message, reserved bits, and parity data.

As shown in FIG. 3C, the HOW word contains GPS time information called the TOW or Time of Week (also called the Z count). The time of week TOW denotes in seconds the time passed since 00:00 of Sunday each week, and is reset to 0 at 00:00 of Sunday each week. More specifically, the TOW denotes the time passed from the beginning of each week in seconds. The time of week TOW denotes the GPS time at which the first bit of the next subframe data is transmitted. For example, the TOW transmitted in subframe 1 denotes the GPS time that the first bit in subframe 2 is transmitted.

The HOW word also contains 3 bits of data denoting the subframe ID (also called the ID code). More specifically, the HOW words of subframes 1 to 5 shown in FIG. 3 (A) contain the ID codes 001, 010, 011, 100, and 101, respectively.

The GPS receiver can get the GPS time by acquiring the week number WN contained in subframe 1 and the time of week TOW contained in subframes 1 to 5. However, if the GPS receiver has previously acquired the week number and internally counts the time passed from when the week number value was acquired, the current week number WN of the GPS satellite can be obtained without acquiring the week number from the satellite signal. The GPS receiver can therefore know the current time, except for the date, once the time of week TOW is acquired. The GPS receiver therefore normally acquires only the time of week TOW as the time information.

*Control Unit Configuration

As shown in FIG. 2, the control unit 30 includes a storage unit 31, oscillation circuit 32, drive circuit 33, timekeeping unit 34, date determination information setting unit 35, date determination unit 36, and time adjustment unit 37, and controls various operations.

The control unit 30 controls the reception unit 20 and display unit 40. More specifically, when the button A 5 is held depressed to start reception, and when the reception time is preset and the preset time arrives, the control unit 30 sends a control signal to the reception unit 20 and controls the reception operation of the reception unit 20. Driving the hands 3 is also controlled by the drive circuit 33 in the control unit 30.

The time kept by the GPS wristwatch 1 (the kept time) is stored in the storage unit 31. The kept time is the time counted by the timekeeping unit 34. The timekeeping unit 34 updates the kept time based on a reference clock signal generated by the oscillation circuit 32. As a result, even if the power supply to the reception unit 20 is stopped, the timekeeping unit 34 can continue updating the kept time and moving the hands 3 accordingly.

The control unit 30 controls operation of the reception unit 20 to acquire the GPS time, and the time adjustment unit 37 corrects and stores the kept time in the storage unit 31 based on the GPS time. More specifically, the time adjustment unit 37 adjusts the kept time to UTC by subtracting the cumulative leap seconds (currently 15 seconds) inserted since 6 Jan. 1980 to the acquired GPS time. When time difference data is stored in the storage unit 31, the time adjustment unit 37 also adds the time difference to set and store the current local time in the storage unit 31.

Note that as described above the time difference (time zone) data is stored according to the city selected in the time zone adjustment mode.

As described below, the date determination information setting unit 35 is for setting information that is used to determine the current date from among the dates for the same week number in each cycle. More specifically, day information set using the operating unit 50 is stored as the date determination information in the storage unit 31.

The date determination unit 36 reads the date corresponding to the week number WN by referring to a week number WN cycle table (week number cycle information) described below, and determines the date for the date determination information set by the date determination information setting unit 35 from the date obtained by adding the time of week TOW to the date in each cycle.

More specifically, based on date determination information correlating week numbers, cycle numbers, and dates, the date determination unit 36 determines the date identified by the week number and time of week in each cycle, extracts the number of the same place as a particular place in the date, and if one of these numbers matches the number of the date determination information, determines that the date containing that number is the current date.

*Week Number WN Cycle Tables

WN cycle tables (week number cycle information) in which week number, cycle number, and corresponding date values are stored as a table for each cycle of week numbers are also stored in the storage unit 31.

FIG. 4 illustrates the correlation between week number and cycle number.

As described above, week number 0 is the week that started 6 Jan. 1980, and when the week number reaches 1023, the week number returns to 0 and advances to cycle 2. The date shown in a matrix of week numbers (0 to 1023) and cycle numbers (1, 2, . . . ) is therefore the date of the first day of the week number, and if the time of week TOW is known in addition to the week number WN, what day in that week it is can also be known. For example, the date corresponding to week number WN 0 in cycle number 1 is 6 Jan. 1980, and how many days it is from 6 Jan. 1980 can be determined from the time of week TOW.

The cycle number is thus information denoting the number of the cycle containing the current week number counted from a predetermined reference date.

FIG. 5 shows the relationship between week number and WN cycle table where 1024 weeks is one cycle starting from a reference point (reference date) of 1 Jan. 2012. More specifically, as shown in FIG. 4, the week number of 1 Jan. 2012 is week number WN 645 of cycle 2 beginning at a GPS time reference date of 6 Jan. 1980. FIG. 5 is a table of WN cycle tables wherein the one cycle A is from week number 645 in cycle 2 to week 644 in the next cycle 3.

Cycle B in FIG. 5 is from week number 645 of cycle 3 in FIG. 4, that is, 17 Aug. 2031, to week number 644 in cycle 4 in FIG. 4, that is, 26 Mar. 2051

WN cycle tables for cycle C and thereafter are configured in the same way as shown in FIG. 5.

In other words, WN cycle tables A to I (cycle numbers A to I) in FIG. 5 are week number cycle information describing the correlation between week numbers and dates for cycles 1 to 9 starting from a reference date of 1 Jan. 2012.

The WN cycle table shown in FIG. 5 is stored as week number cycle information in the storage unit 31.

FIG. 6 shows only the day values of the dates (year, month, day) shown in the matrix of the WN cycle table in FIG. 5.

Similarly to FIG. 5, the WN cycle table in FIG. 6 shows only some of the week numbers and omits the others. Note that all week numbers 645-1023 and 0-644 and the corresponding date (day value) are shown in FIG. 7 to FIG. 15 for cycles A to C only.

As will be known from FIG. 7 to FIG. 15, no two days for the same week number are the same in any two consecutive (adjacent) WN cycles such as A and B or B and C, but there are instances in which the day value is the same for the same week number WN in every other WN cycle, such as A and C. For example, as shown in FIG. 5, the date for week number 0 in WN cycle A is 7 Apr. 2019, and in WN cycle B is 21 Nov. 2038. The "day" of week number 0 in WN cycle A is therefore 7, the day in WN cycle B is 21, and even though the week numbers WN are the same, the "day" column values are not the same. However, the date for week number WN 0 in WN cycle C is 7 Jul. 2058, the day is therefore 7, and while the day is different from the day in WN cycle B, it is the same as the day in WN cycle A.

The day value of the dates for the same week number will therefore not be the same in any two consecutive WN cycles (cycle numbers). As a result, the date determination unit 36 sets a default WN cycle table (such as WN cycle A); sets a search range in that WN cycle table (WN cycle A in this example) and the next WN cycle table (WN cycle B in this example), that is, two consecutive WN cycle tables; reads the date (year, month, day) of the received week number WN from the WN cycle tables (week number cycle information) when the week number WN and time of week TOW values are acquired; and adds the received time of week TOW to the read date to determine the date in each cycle (that is, in WN cycle tables (cycles) A and B).

The date determination unit 36 then compares the day unit of this date with the day that was manually set as the date determination information. If the day of the date in one of these cycles matches the date determination information, the date (year, month, day) including that day can be determined to be the current date. In addition, if the current date can be determined, the WN cycle table (cycle number) containing the current date can also be determined.

By thus limiting the search range to two consecutive WN cycle tables, the date corresponding to week number WN can be read from the WN cycle table, the date in each cycle can be determined by adding the read date and the day calculated from the time of week TOW, and these days can be compared with the day set as the date determination information to determine the current date. Once the current date (year, month, day) is known, the time expressed as the current year, month, day, hour, minute, and second can be determined using the time of week TOW, and the correct time can be set.

As described above, by thus setting a search range in WN cycles A and B in the WN cycle table shown in FIG. 5, and setting the day of the current reception date as the date determination information, the current date can be determined in the range from 1 Jan. 2012 to 1 Apr. 2051 using the date determination information. As a result, the time kept by the GPS wristwatch 1 can be adjusted to the correct date and time using the received week number WN and time of week TOW.

In addition, because the WN cycle table (cycle number) containing the current date can be determined, this cycle number can be set as the default value, the received week number WN, time of week TOW, and this default cycle number can be used when signals are next received after this adjustment is made to determine the current time (the year, month, day of the current date and the hour, minute, second of the current time), and the correct date and time can be set.

*Reception Process

The process executed by the control unit 30 when the reception process is executed in the GPS wristwatch 1 according to this first embodiment of the invention is described next with reference to the flow chart in FIG. 16.

When a preset reception time arrives or reception is manually started by the button A 5 being pressed for a specific period of time, the control unit 30 of the GPS wristwatch 1 executes the reception process. More specifically, the reception unit 20 is started by a control signal from the control unit 30, and the reception unit 20 starts receiving satellite signals transmitted from the GPS satellites (S11).

The control unit 30 then determines if the week number WN and time of week TOW were successfully received by receiving a satellite signals (S12).

If the week number WN and time of week TOW were successfully received (S12 returns Yes), the control unit 30 determines before starting reception if the "day" value (date determination information) was manually set (S13). More specifically, the control unit 30 determines if, in the time between the last time the reception process was executed and the time the current reception process was invoked, the crown 7 was pulled out one stop, the date adjustment mode was selected by the date determination information setting unit 35, and button A 5 or button B 6 was pressed to set the day (date determination information) using the date wheel 8. Note that the control unit 30 can easily determine if the day was set by operating the button A 5 or button B 6 by, for example, setting and storing a configuration flag in the storage unit 31.

If the day was manually set and the date determination information was set (S13 returns Yes), the date determination unit 36 of the control unit 30 reads the dates (year, month, day) corresponding to the received week number WN from the WN cycle table, adds the received time of week TOW to each of the extracted dates, and determines the date for each cycle number (S14). For example, if cycle numbers A and B are set as the search range, the dates in WN cycles A and B are calculated by reading the date in WN cycle A and the date in WN cycle B corresponding to the received week number WN, and adding the time of week TOW to these dates.

Using these dates in WN cycles A and B, the date determination unit 36 then determines if there is a date of which the day matches the day that was manually set (S15).

If a matching date is found (S15 returns Yes), the time adjustment unit 37 of the control unit 30 calculates the current time using this date and the time of week TOW, and uses this time to adjust the time kept internally (S16). In addition, the control unit 30 sets the WN cycle table containing this date as the default table (S17). As a result, this default table is used as the starting point of the search range the next time the reception process executes. More specifically, if the date is found in WN cycle B, WN cycle B is set as the default table, and the search range the next time the reception process executes is set to WN cycle tables B and C (cycle numbers B and C).

Figure 16:
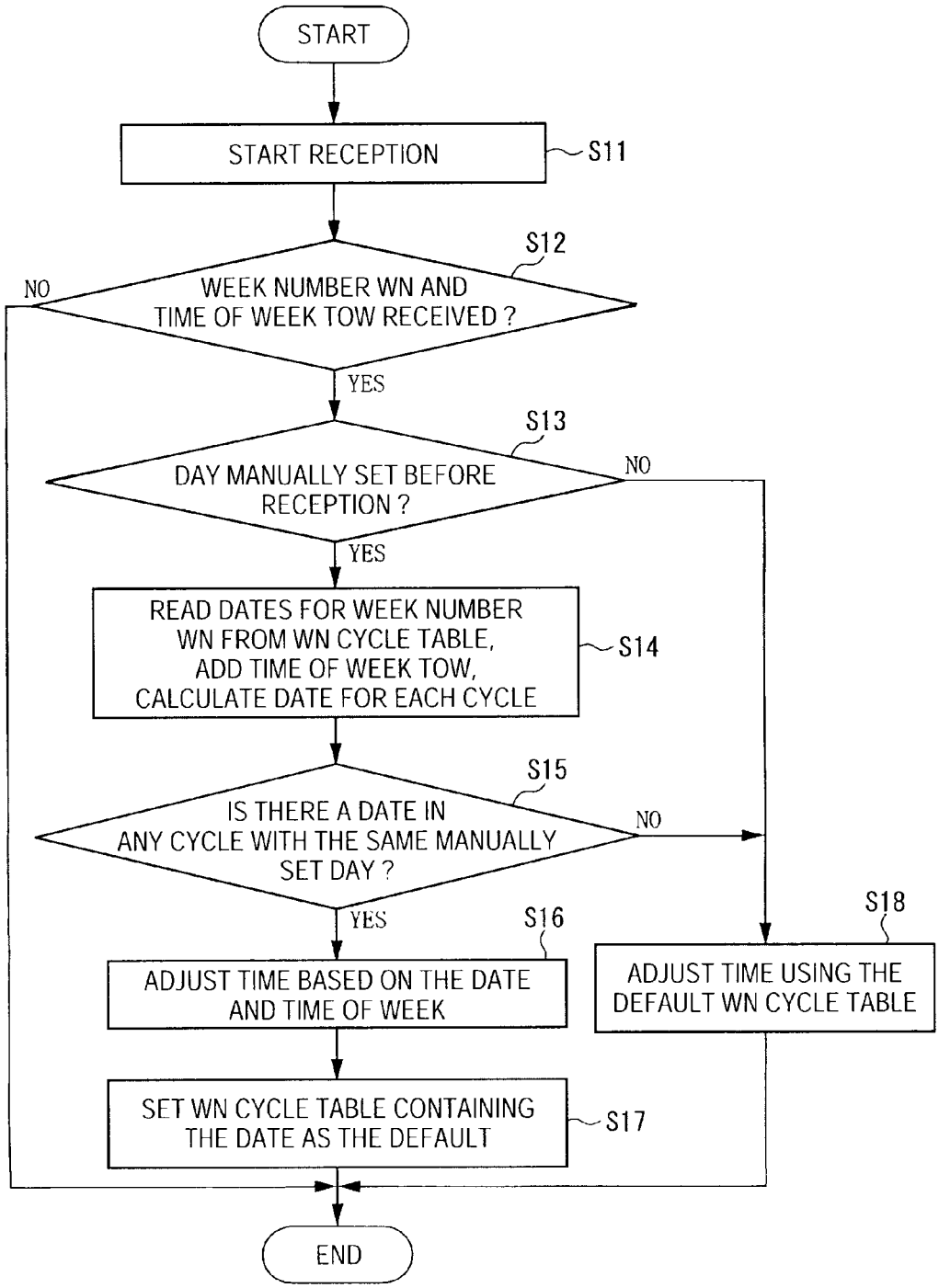
FIG. 16 is a flow chart showing the reception process in the first embodiment of the invention.

When step S17 executes, the control unit 30 deletes the manually set day (date determination information) from the storage unit 31 and ends the reception process in FIG. 16.

If the day (date determination information) was not manually set before the reception process started, that is, if S13 returns No, the time adjustment unit 37 of the control unit 30 reads the date corresponding to the received week number WN from the default WN cycle table without determining the WN cycle table because the date determination information is not set, and adjusts the kept time using the time of week TOW (S18).

In addition, if S15 returns No, the time adjustment unit 37 of the control unit 30 adjusts the kept time using the date read from the default WN cycle table and adjusts the time (S18).

Yet further, if receiving the week number WN and time of week TOW failed (S12 returns No), the control unit 30 cannot adjust the time and therefore ends the reception process.

The process executed by the control unit 30 when the day was manually set is described next with reference to the flow chart in FIG. 17.

Figure 17:
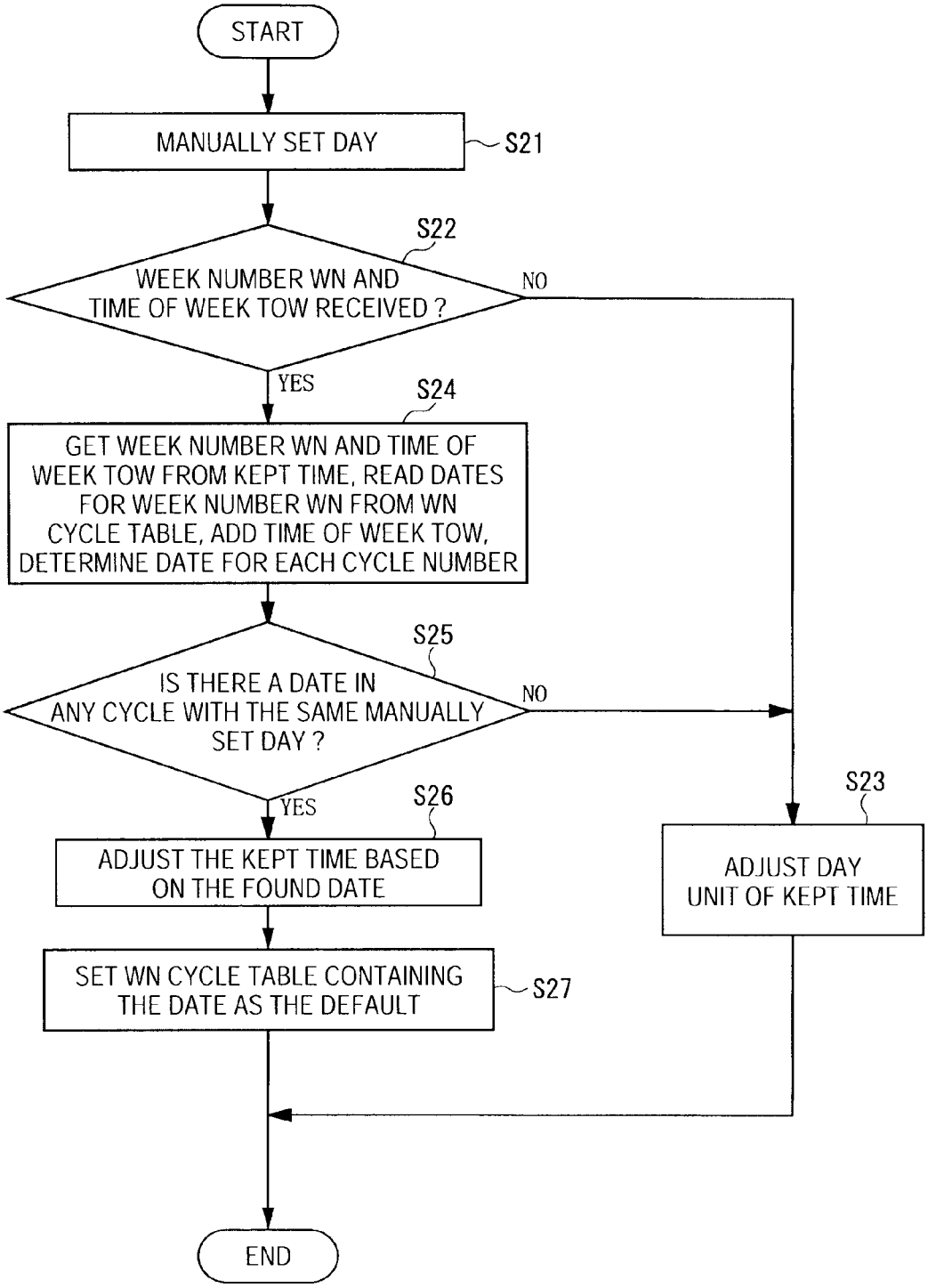
FIG. 17 is a flow chart showing the process for manually setting the day in the first embodiment of the invention.

The control unit 30 executes the process in FIG. 17 when the crown 7 is pulled out one stop and the date adjustment mode is set.

The date determination information setting unit 35 of the control unit 30 detects manual setting of the day using the button A 5 and button B 6, and stores the set day (date determination information) in the storage unit 31 (S21).

The control unit 30 then determines if the reception process executed and the week number WN and time of week TOW were successfully acquired before the day was manually set (S22).

If reception was determined not successful in S22 (S22 returns No), such as when the reception process did not execute (such as when the day was not set manually before the reception process was called after initializing the GPS wristwatch 1 by replacing the battery, for example) or when reception failed because the reception process was executed in a poor reception environment, the control unit 30 adjusts the day value of the kept time to the day set in step S21 (S23). For example, if the 18th was set manually in S21, the control unit 30 adjusts the day value of the kept time stored in the storage unit 31 to the 18th.

However, if reception of the week number WN and time of week TOW is determined successful in S22 (S22 returns Yes), after reception succeeds the user can determine that the date presented on the date wheel 8 is incorrect and know that the day was manually set.

The control unit 30 therefore determines the week number WN and time of week TOW from the time kept by the timekeeping unit 34 (the kept time), reads the dates corresponding to the week number WN from the WN cycle table, adds the time of week TOW to the read dates, and calculates the date for each cycle number (S24).

More specifically, if the week number WN and time of week TOW were successfully received, S12 in FIG. 16 returns Yes, and the kept time is adjusted based on the received week number WN and time of week TOW by either S16 or S18. The time that is set during the reception process is updated thereafter by the timekeeping unit 34. In S24, therefore, the control unit 30 can calculate the week number WN and time of week TOW at the current time from the time (kept time) kept by the timekeeping unit 34. The date determination unit 36 of the control unit 30 then reads the dates from the WN cycle tables based on the week number WN at the current time, and determines the date in each cycle based on the read dates and the time of week TOW.

The date determination unit 36 of the control unit 30 then determines if the day value of one of the dates for the cycle numbers obtained in S24 matches the manually set day value (S25).

If a date with a matching day value is not confirmed in S25 (S25 returns No), the control unit 30 adjusts the day place of the kept time to the set day value (S23).

If a date with a matching day value is confirmed in S25 (S25 returns Yes), the time adjustment unit 37 of the control unit 30 adjusts the date value (year, month, day) of the kept time to that day value (S26).

The control unit 30 then sets the WN cycle table containing said date as the default table (S27), and the default table becomes the starting point of the search range the next time the reception process executes.

When S27 executes, the control unit 30 deletes the manually set day (date determination information) from the storage unit 31, and ends the date adjustment mode process shown in FIG. 17.

When S23 executes, the control unit 30 ends the date adjustment mode process while leaving the manually set day (date determination information) in the storage unit 31.

An applied example of the processes shown in FIG. 16 and FIG. 17 is described next. Note that in these examples selected parameters such as the reception date and the default WN cycle table are set when the process executes.

*EXAMPLE 1

Reception without Manually Setting the Day (Date Determination Information)

This situation occurs when the reception process is executed to set the time after initializing the GPS wristwatch 1 by replacing the battery, for example.

The following conditions apply to this example.

Reception location: Tokyo

Reception date: 2 Jan. 2012

Time zone setting: +9 hours

Default WN cycle table: A

Received week number WN and time of week TOW:

WN=645

TOW=79221 s=0 d×86400+22 h×3600+0 m×60+21 s

When the week number WN and time of week TOW shown above are successfully received in the reception process in S11 in FIG. 16, S13 returns No because the day was not manually set before reception. As a result, the control unit 30 adjusts the kept time as described below based on the default WN cycle table A (S18).

More specifically, as described above, because WN=645 and TOW=79221, the GPS time is 22 h 00 m 21 s on the first day of week 645.

Because WN cycle A is set as the default WN cycle table, the week of WN=645 is known to be the week of 1 Jan. 2012 by referring to WN cycle table A in FIG. 5. The first day of week 645 is thus 1 Jan. 2012, and the GPS time based on the received data is 22 h 00 m 21 s on 1 Jan. 2012. By subtracting the cumulative leap seconds (15 seconds) from the GPS time, UTC is known to be 22 h 00 m 06 s on 1 Jan. 2012. Because the set time difference is +9 hours, adding 9 hours to UTC gets the current local time and date of 2 Jan. 2012, 7 h 00 m 06 s.

The control unit 30 therefore adjusts the kept time to the above time, and adjusts the display unit 40 to the kept time using the drive circuit 33. The date displayed by the date wheel 8 therefore goes to 2.

Because the correct date is thus displayed in this example, the user can continue using the GPS wristwatch 1 without needing to manually set the date.

As described in this example, when the default WN cycle table is A and the actual date is within the range of WN cycle table A, or more specifically is from 1 Jan. 2012 to 16 Aug. 2031, the time can be automatically adjusted to the correct time by receiving signals without manually setting the date, and the time displayed by the hands 3 and date wheel 8 can also be automatically adjusted. Therefore, even if the GPS wristwatch 1 has been initialized as a result of changing the battery, for example, the correct time can be automatically set by using reception alone during the period of the default WN cycle table A (1 Jan. 2012-16 August 2031).

*EXAMPLE 2

Reception on a Date not Found in the Default WN Cycle Table Without Manually Setting the Day (Date Determination Information)

The following conditions apply to this example.

Reception location: Tokyo

Reception date: 18 Aug. 2031

Time zone setting: +9 hours

Default WN cycle table: A

Received week number WN and time of week TOW:

WN=645

TOW=79221 s=0 d×86400+22 h×3600+0 m×60+21 s

Because the day was not manually set before reception in this example (S13 in FIG. 16 returns No), the control unit 30 executes the internal time adjustment process described below with reference to the default WN cycle table A (S14).

More specifically, as described above, because WN=645 and TOW=79221, the GPS time is 22 h 00 m 21 s on the first day of week 645.

Because WN cycle A is set as the default WN cycle table as described in example 1 above, the week of WN=645 is known to be the week of 1 Jan. 2012 by referring to WN cycle table A in FIG. 5. The first day of week 645 is thus 1 Jan. 2012, and the GPS time based on the received data is 22 h 00 m 21 s on 1 Jan. 2012. Because UTC is known to be 22 h 00 m 06 s on 1 Jan. 2012, and the set time difference is +9 hours, the current local time and date are 2 Jan. 2012, 7 h 00 m 06 s.

The control unit 30 therefore adjusts the kept time to this time, and the date displayed by the date wheel 8 goes to 2.

However, because the actual date (signal reception date) is 18 Aug. 2031, the user will normally know that the date is wrong and manually set the date to the 18th (S21 in FIG. 17).

In this instance, because reception was successful, the control unit 30 returns Yes in S22 and executes step S24.

Because the control unit 30 knows from the year, month, day, hour, minute, second of the kept time (2012 y 1 m 2 d 7 h 00 m 06 s) that the current week number WN and time of week TOW denote day 1 of week 645 (day 2 in Tokyo), the control unit 30 reads the date (year, month, day) of week 645 from WN cycle tables A and B, adds one day because it is the second day, and gets candidate dates of 2012 y 1 m 2 d and 2031 y 8 m 18 d. These candidate dates are then compared with the date determination information (18th) set in S21. This comparison shows that the date with a day value of 18 is the date defined by the week number WN 645 and time of week TOW (18 Aug. 2031) in WN cycle table B. The control unit 30 therefore adjusts the year of the kept time to 2031, the month to 8, and the day to 18 (S26).

More specifically, as shown in FIG. 5, because the first day of week 645 is 1 in table A and 17 in table B, day 2 of week 645 is the 2nd in table A, and the 18th in table B, and the manually set date of the 18th and table B are known to match (S25). Furthermore, because the reference point (reference date) for WN cycle table B is week 645 starting 17 Aug. 2031 as shown in FIG. 5, the control unit 30 adjusts the year of the kept time to 2031 y and the month to 8 m (S26). In addition, because the 18th was set in S21, the day of the kept time is also adjusted to 18 d (S26).

The control unit 30 then sets WN cycle table B as the default (S27).

Note that in this second example the day is manually set to the reception date, but the time can be correctly adjusted even if the date is manually set to the next day or some future date. More specifically, because the current week number WN and time of week TOW are obtained from the year, month, day, hour, minute, second of the kept time in S24, the year, month, day of the kept time will be 2012 y 1 m 3 d if manually set to the next day in this example, and will be known to be day 3 of week 645. In addition, because the manually set date (the next day) is 2031 y 8 m 19 d, the date determination information (displayed date) set in S21 will be the 19th. Because the control unit 30 also knows in this situation that WN cycle table B applies, it sets the date to 19 Aug. 2031 (S26).

*EXAMPLE 3

Reception Soon after Manually Setting the Day on a Date not in the Default WN Cycle Table The following conditions apply to this example.

Reception location: Tokyo

Reception date: 25 Nov. 2038

Time zone setting: +9 hours

Default WN cycle table: A

This third example describes the process when the user manually sets the 25th, the current reception date, in S21 in FIG. 17 and the reception process then executes in S11 in FIG. 16.

Because reception did not occur previously in this example (S22 returns No), the control unit 30 adjusts only the day of the kept time (S23). Because the control unit 30 updates the kept time using a signal from the oscillation circuit 32 and does not know the year and month until reception is successful, whether the month is a long month or short month is not known. As a result, the control unit 30 advances the day of the kept time to (and displays) the 31st.

Data is thereafter received by the process in S11.

The received week number WN and time of week TOW:

WN=0

TOW=367850 s=4 d×86400+6 h×3600+10 m×60+50 s

Because the day was manually set before reception in this example, S13 returns Yes, S14 executes, and the decision step of S15 executes.

The GPS time, however, is 6 h 10 m 50 s on day 5 of week 0. By subtracting the cumulative leap seconds (15 seconds) from the GPS time, UTC is known to be 6 h 10 m 50 s on day 5 of week 0. Because the set time difference is +9 hours, adding 9 hours to UTC gets the current local time and date of 15 h 10 m 35 s on day 5 of week 0.

However, day 5 of WN=0 in WN cycle table A is the 11th (2019 y 4 m 11 d), and in WN cycle table B is the 25th (2038 y 11 m 25 d). Because the manually set day is also 25, the control unit 30 determines that the date in WN cycle table B (2038 y 11 m 25 d) matches the manually set date (S15).

Using this date (2038 y 11 m 25 d) and the time of week TOW, the control unit 30 determines the current time of 2038 y 11 m 25 d 6 h 10 m 35 s, and adjusts the kept time accordingly (S16). The control unit 30 then sets WN cycle table B as the default S17).

*Operating Effect of Embodiment 1

If the user manually sets only the day before or after reception, this aspect of the invention can determine the current date using the set day (date determination information) and the received week number WN and time of week TOW, and as a result can adjust the kept time to the correct time.

Operability can thus be improved because the correct time can be set by setting the date using the same operation used with a conventional timepiece instead of setting the year, month, day as in the prior art.

Furthermore, because the day set by the user can be the day that the day is set, the time can be automatically adjusted by using a simple operation with no particular knowledge about the GPS, and convenience is thus excellent.

Yet further, because the current date can be determined and the correct time can be set whether the day is manually set after reception or whether reception follows manually setting the day, there is no need for the user to be aware of a particular sequence, thereby further improving convenience.

In addition, because the time is adjusted using the default WN cycle table when reception occurs without manually setting the day in the process shown in FIG. 16 (S13 returns No), and when said day does not exist in S15, if the reception date and time are within the range of the default WN cycle table, the correct time can be set based on reception alone, manually setting the day is not necessary, and convenience can be further improved.

In addition, if the actual date is not in the default WN cycle table, the wrong date is displayed by the date wheel 8, and the user adjusts the date display in S21, the appropriate date can be determined in S24 to S27 and the correct time set, reception does not need to be repeated, and convenience can thus be improved.

More particularly, when the GPS wristwatch 1 has been reset by replacing the battery, for example, after one cycle (approximately 19.7 years) since the reference date of the default WN cycle table has passed, the week number WN and time of week TOW are then received and the time is adjusted using the default WN cycle table, the user can easily know that the date is wrong because the date is normally displayed on the date wheel 8. The likelihood that the user will then quickly adjust the date, which the user can easily recognize to be wrong, is therefore high and the correct time can be quickly reset.

In addition, if the day is manually set when reception did not succeed (S22 returns No), or if the corresponding WN cycle table is not present in S25, the day value of the kept time is adjusted using the manually set day, and the date set by the user can at least be displayed on the date wheel 8 and used. Convenience can thus be improved because the date set by the user can be displayed until reception occurs when in a location where reception is not possible, for example.

Yet further, because the day is set as the manually set date determination information in this embodiment of the invention, the date wheel 8 can be easily set to the desired date using button A 5 and button B 6. More specifically, because the operation for setting the date determination information is the same as the normal date setting operation of the timepiece, the user can easily learn how to set the date determination information, and convenience can be improved accordingly.

*Embodiment 2

Figure 19:
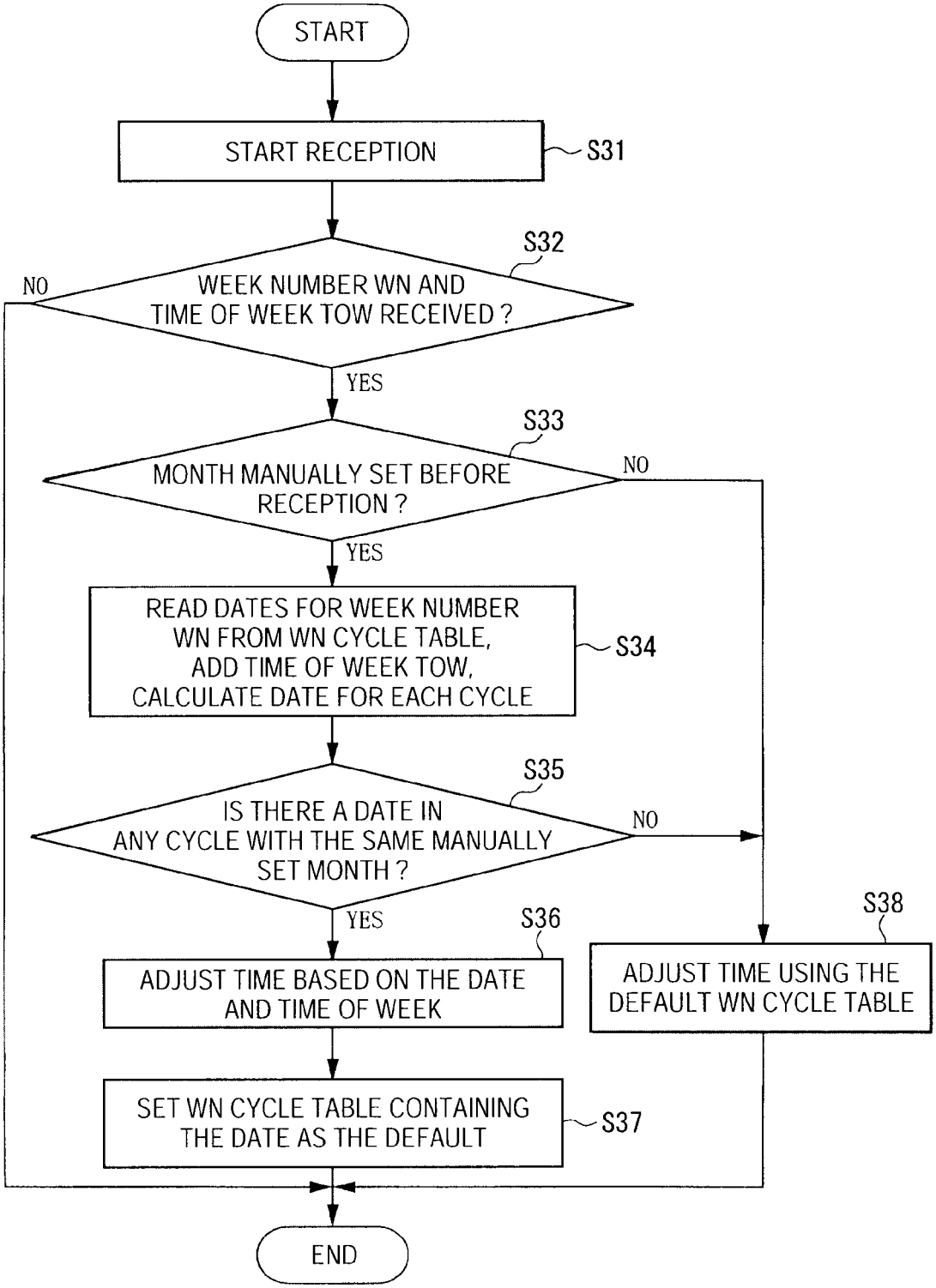
FIG. 19 is a flow chart showing the reception process in the second embodiment of the invention.

A second embodiment of the invention is described next with reference to FIG. 18, FIG. 19, and FIG. 20.

This second embodiment of the invention differs from the first embodiment of the invention in using the month instead of the day as the manually set date determination information, and other aspects thereof are the same. The following description of the second embodiment therefore addresses the parts that differ from the first embodiment, and further description of like parts is omitted.

WN cycle tables as shown in FIG. 5 and described in the first embodiment are stored in the storage unit 31 of the GPS wristwatch 1 according to the second embodiment of the invention.

However, this embodiment uses the month as the date determination information. Determining the current date based on this month value is described with reference to FIG. 18.

FIG. 18 shows only the month values extracted from the WN cycle tables shown in FIG. 5. As will be known from FIG. 18, there is no duplication of month values for the same week number in WN cycle tables (cycle numbers) A to H. These tables can therefore be used for dates starting from 1 Jan. 2012 (reference date) to 31 Dec. 2168.

Compared with using the day, this embodiment of the invention is compatible with a greater range of years without adjusting the range of WN cycle tables that are searched.

The process executed in this second embodiment of the invention is the same as in the first embodiment. That is, as shown in FIG. 19 and FIG. 20, the same process as the first embodiment can be used by substituting "month" for "day" in the first embodiment.

More specifically, when executing the reception process, the control unit 30 starts reception in S31, determines in S32 if receiving the week number WN and time of week TOW succeeded, and if reception was a success, determines in S33 if the month was manually set before reception. If it was manually set, the control unit 30 reads the dates corresponding to the week number WN from the WN cycle table, adds the time of week TOW to each date, and determines the date in each cycle (S34).

Next, using the dates determined for each cycle, the date determination unit 36 looks for a date having a month that matches the manually set month (S35).

If a matching date is found, the current time is calculated using that date and the time of week TOW, and the kept time is adjusted (S36). In addition, the control unit 30 sets the WN cycle table containing that date as the default table (S37). When step S37 is executed, the control unit 30 deletes the manually set month (date determination information) from the storage unit 31, and ends the reception process in FIG. 19.

However, if S33 returns No, and if step S35 returns No, the control unit 30 adjusts the time using the default WN cycle table (S38).

Figure 20:
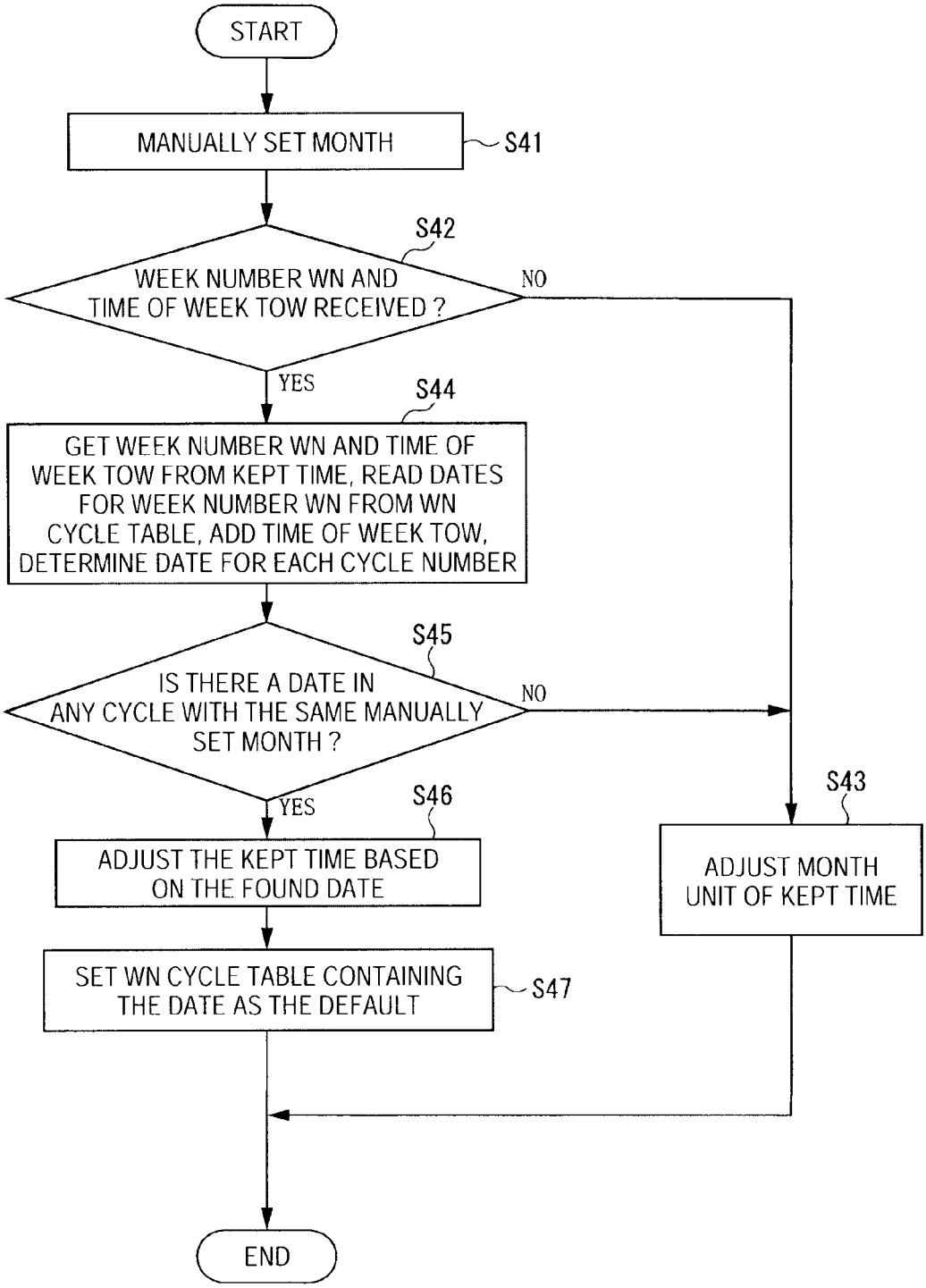
FIG. 20 is a flow chart showing the process for manually setting the month in the first embodiment of the invention.

The control unit 30 executes the process shown in FIG. 20 when the month adjustment mode is entered. This month adjustment mode can be set by pulling the crown 7 out one stop in the same way as the date adjustment mode in the first embodiment.

Because the month ranges from January (1 m) to December (12 m), the month can be set using the second hand 3A and the hour markers 1 to 12. More specifically, in the month adjustment mode, the second hand 3A moves +1 m (one month forward) when button A 5 is pressed, and −1 m (one month back) when button B 6 is pressed. If the second hand 3A is pointing at 1 when the crown 7 is pushed in to cancel the month adjustment mode, the month is set to January (1 m). If the crown 7 is pushed in when the second hand 3A is pointing to 2 to 12 to cancel the month adjustment mode, the month is similarly set to the corresponding month of February (2 m) to December (12 m).

When the month is manually set by the operation in S41, the control unit 30 determines if receiving the week number WN and time of week TOW succeeded (S42), and if reception succeeded, determines the week number WN and time of week TOW from the kept time, reads the dates corresponding to the week number WN from the WN cycle table, adds the time of week TOW to each date, and determines the date in each cycle (S44).

Using the dates for each cycle determined in S44, the date determination unit 36 then looks for a date having a month value matching the manually set month (S45).

If a matching date is found, the time adjustment unit 37 adjusts the date of the kept time (the year, month, day unit) (S46), and sets the corresponding WN cycle table as the default table (S47). When step S47 is executed, the control unit 30 deletes the manually set month (date determination information) from the storage unit 31, and ends the month adjustment mode process.

If S42 returns No, and if S45 returns No, the control unit 30 adjusts the month value of the kept time to the manually set month (S43), and ends the month adjustment mode process.

Figure 21:
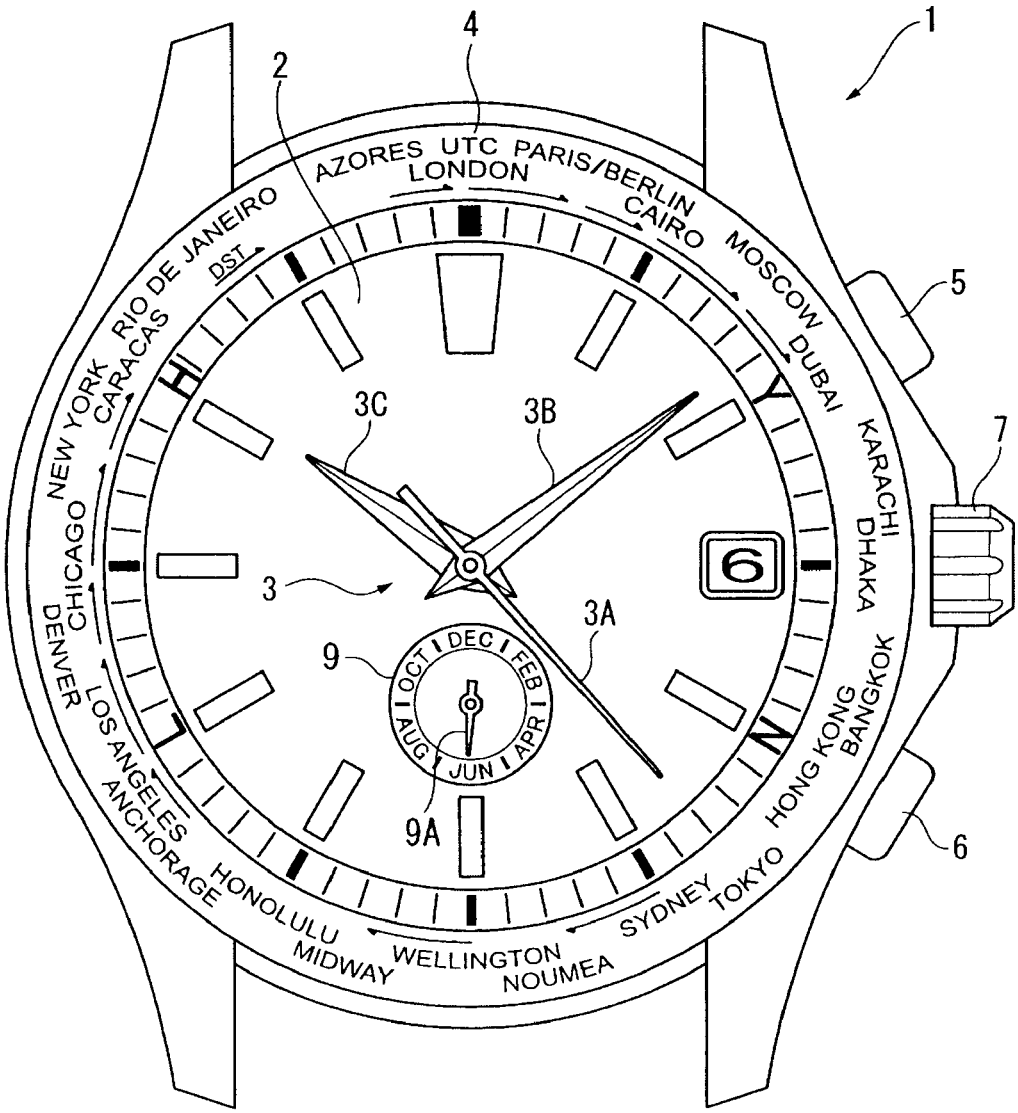
FIG. 21 is a front view of a timepiece having a month display unit in a second embodiment of the invention.

Note that the month is set using the second hand 3A in this embodiment of the invention, but if the GPS wristwatch 1 has a month display unit 9 as shown in FIG. 21, the hand 9A of the month display unit 9 could be moved by operating a button to set the month used as the date determination information.

This embodiment of the invention executes a process similar to the first embodiment of the invention.

For example, when the process is executed under the same conditions described in the first example in the first embodiment, the time determined from the received data is 2012 y 1 m 2 d 7 h 00 m 06 s because WN=645 and the WN cycle table set as the default is A.

Therefore, the control unit 30 adjusts the kept time to this time, and using the drive circuit 33 adjusts the display unit 40 to the kept time. As a result, the date displayed by the date wheel 8 goes to 2. In addition, when there is a month display unit 9 as shown in FIG. 21, the hand 9A points to January.

A fourth example corresponding to the foregoing example 2 is described below.

*EXAMPLE 4

Reception without Manually Setting the Month on a Date not Found in the Default WN Cycle Table The following conditions apply to this example.

Reception location: Tokyo

Reception date: 19 May 2149

Time zone setting: +9 hours

Default WN cycle table: A

Received week number WN and time of week TOW:

WN=645

TOW=79221 s=0 d×86400+22 h×3600+0 m×60+21 s

Because the month was not manually set before reception in this example, the control unit 30 executes the time adjustment process described below based on the default WN cycle table A (S38).

More specifically, as described above, because WN=645 and TOW=79221, the GPS time is 22 h 00 m 21 s on the first day of week 645 as described in example 1 above.

Also, because WN cycle A is set as the default WN cycle table as described in example 1 above, the week of WN=645 is known to be the week of 1 Jan. 2012 by referring to WN cycle table A in FIG. 5. The first day of week 645 is thus 1 Jan. 2012, and the GPS time based on the received data is 22 h 00 m 21 s on 1 Jan. 2012. UTC is 22 h 00 m 06 s on 1 Jan. 2012, the set time difference is +9 hours, and the current local time and date are 7 h 00 m 06 s on 2 Jan. 2012.

The control unit 30 therefore adjusts the kept time to this time, and the date displayed by the date wheel 8 goes to 2.

However, because the actual date (signal reception date) is 19 May 2149, the user will normally know that the date is wrong, or that the month is wrong if there is a month display unit 9 as shown in FIG. 21, and manually set the month to May (S41 in FIG. 20). Because reception was successful, the control unit 30 returns Yes in S42 and executes step S44.

Because the control unit 30 knows from the year, month, day, hour, minute, second of the kept time (2012 y 1 m 2 d 7 h 00 m 06 s) that the current week number WN and time of week TOW denote day 1 of week 645 (day 2 in Tokyo), the control unit 30 reads the date (year, month, day) of week 645 from WN cycle tables A to H, and adds one day because it is the second day. Using these calculated dates, the control unit 30 then looks for a date of which the month value matches the date determination information (May) set in S41. This shows that the date with a month value of 5 is the date defined by the time of week TOW and the week number WN 645 in WN cycle table H (19 May 2149) (S45).

More specifically, as shown in FIG. 5, because the month of the date of the second day in week 645 is January in table A, August in table B, April in table C, November in table D, July in table E, February in table F, October in table G, and May in table H, a match between the manually set month (5) and the month of the date in table H is confirmed. As also shown in FIG. 5, because the second day of week 645 starting at the origin (reference date) of WN cycle table H is 19 May 2149, the control unit 30 adjusts the year of the internal time to 2149, the month to 5, and the day to 19 (S46).

The control unit 30 then sets the default WN cycle table to H (S47).

Because the user can check the displayed day or month after the time is thus adjusted, that the date is correct can be confirmed.

Mathematically, after eight cycles (157 years) from a starting point of 1 Jan. 2012, the reference date will return to 1 January. More specifically, because there are 39 leap years in this span of 157 years, the total number of days is 365 d×118 y+366 d×39 y (leap years)=57344 days.

In addition, one week number WN cycle=1024 weeks×8 cycles=8192 weeks×7 days=57344 days, the same number of days as in this 157 year period. The WN cycle tables can therefore be set so that a period of eight cycles from the starting date, that is, a WN cycle table covering eight cycles, is searched.

*Operating Effect of Embodiment 2

This embodiment of the invention has the same effect as the first embodiment.

More specifically, if the user manually sets the month as the date determination information before or after reception, the current date can be determined using that month and the received week number WN and time of week TOW, and the correct time can be set as a result.

Operability can therefore be improved because the correct time can be set by setting the month instead of setting the year, month, day as in the prior art.

Furthermore, because the month set by the user is a value of 1 to 12, the month can be set by pointing the second hand 3A to the 1 to 12 hour markers of the timepiece. Because the month can be easily set using button A 5 and button B 6 similarly to setting the day, usability is excellent.

Yet further, because setting the month of the date on which the setting operation is performed is sufficient, the time can be automatically adjusted by a simple operation with no particular knowledge about the GPS, and convenience is thus excellent.

Yet further, while the WN cycle tables that can be differentiated by setting the date in the first embodiment is a range of two consecutive WN cycle tables, that is, a range of approximately 39.4 years, this embodiment of the invention as described above can evaluate WN cycle tables covering a span of approximately 157 years and acquire the correct time.

*Embodiment 3

Figure 23:
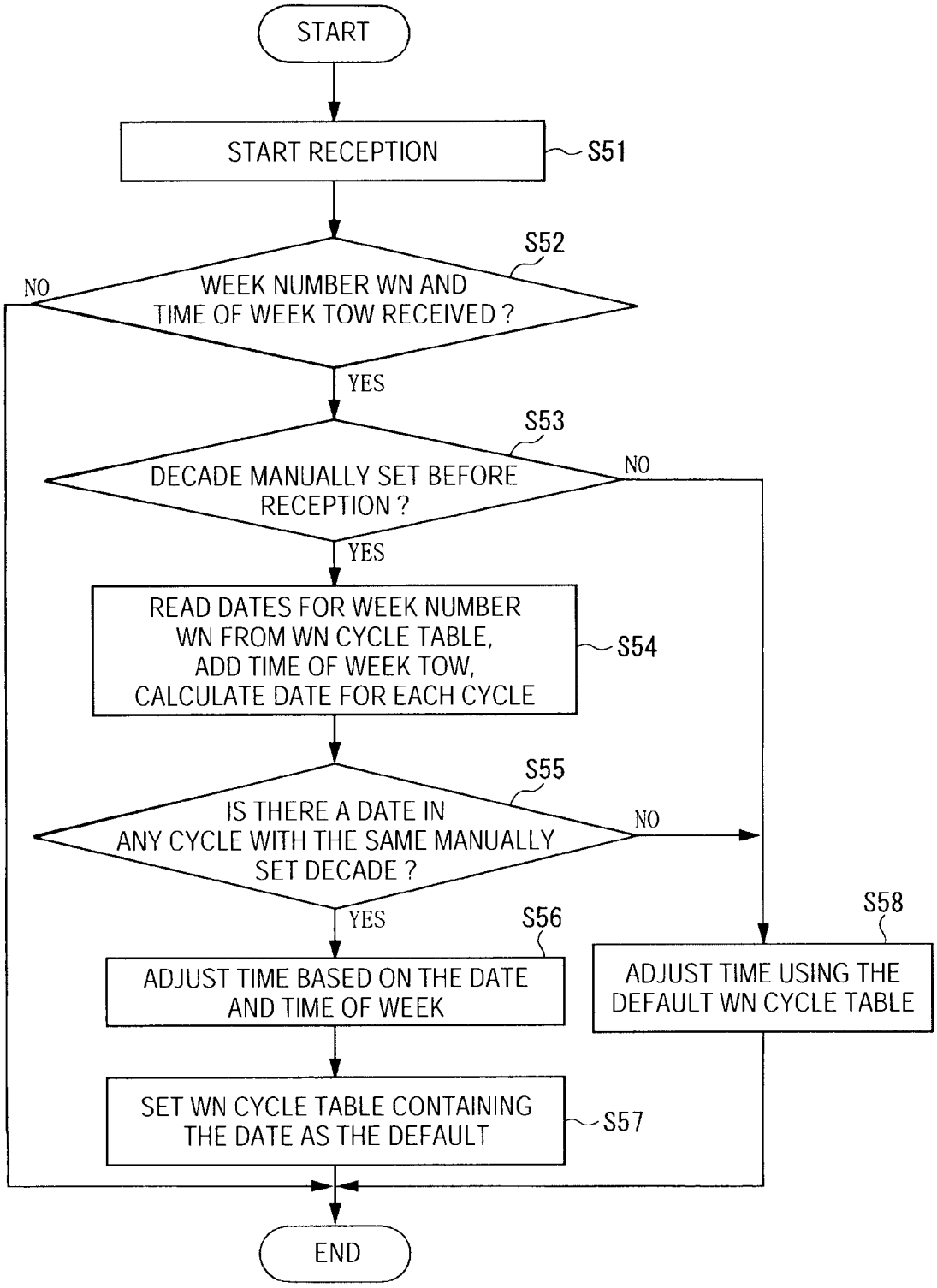
FIG. 23 is a flow chart showing the reception process in the third embodiment of the invention.

A third embodiment of the invention is described next with reference to FIG. 22, FIG. 23, and FIG. 24.

This third embodiment of the invention differs from the previous embodiments by using the tens digit of the Gregorian year, that is, the decade value, instead of the day or the month as the manually set date determination information, and other aspects of the embodiments are the same. The following description of the third embodiment therefore addresses the parts that differ from the foregoing embodiments, and further description of like parts is omitted.

WN cycle tables as shown in FIG. 5 and described in the previous embodiments are stored in the storage unit 31 of the GPS wristwatch 1 according to the third embodiment of the invention.

However, this embodiment uses the tens digit of the year (referred to herein as the decade) as the date determination information. Selecting the WN cycle table based on the decade is described with reference to FIG. 22.

FIG. 22 shows only the decade values extracted from the WN cycle tables in FIG. 5. As shown in FIG. 22, there is no duplication of the decade value for any same week number in WN cycle tables A to E. These tables can therefore be used for the approximately 98 year span of dates starting from 1 Jan. 2012 (reference date) to 15 Feb. 2110.

Compared with using the day, this embodiment of the invention is compatible with a greater range of years without adjusting the range of WN cycle tables that are searched.

The process executed in this third embodiment of the invention is the same as in the foregoing embodiments. That is, as shown in FIG. 23 and FIG. 24, the same process as the first embodiment can be used by substituting "decade" for "day" in the first embodiment.

More specifically, when executing the reception process, the control unit 30 starts reception in S51, determines in S52 if receiving the week number WN and time of week TOW succeeded, and if reception was a success, determines in S53 if the decade was manually set before reception. If it was manually set, the control unit 30 reads the dates corresponding to the week number WN from the WN cycle table, adds the time of week TOW to each date, and determines the date in each cycle (S54).

Next, using the dates determined for each cycle, the date determination unit 36 looks for a date having a decade that matches the manually set decade (S55).

If a matching date is found, the current time is calculated using that date and the time of week TOW, and the kept time is adjusted (S56). In addition, the control unit 30 sets the WN cycle table containing that date as the default table (S57). When step S57 is executed, the control unit 30 deletes the manually set decade (date determination information) from the storage unit 31, and ends the reception process in FIG. 23.

However, if S53 returns No, and if step S55 returns No, the control unit 30 adjusts the time using the default WN cycle table (S58).

Figure 24:
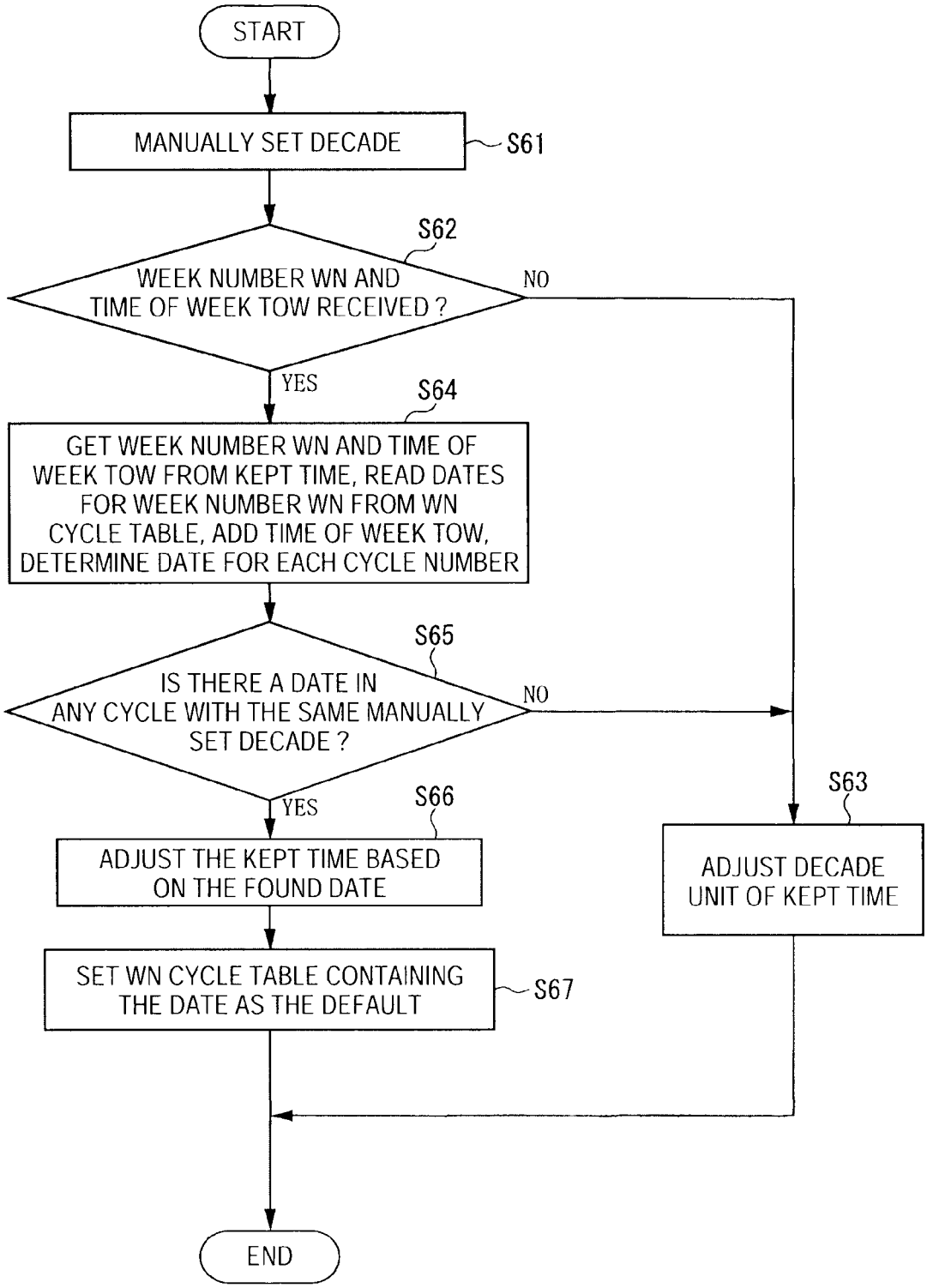
FIG. 24 is a flow chart showing the process for manually setting the decade in a third embodiment of the invention.

The control unit 30 executes the process shown in FIG. 24 when the decade adjustment mode is entered. This decade adjustment mode can be set by pulling the crown 7 out one stop in the same way as the date adjustment mode in the first embodiment.

Because the decade number ranges from 0 to 9, it is set using the second hand 3A and the hour markers 0 (12) to 9 (S61). More specifically, in the decade adjustment mode, the second hand 3A moves +10 years when button A 5 is pressed, and −10 when button B 6 is pressed. If the second hand 3A is pointing at 0 when the crown 7 is pushed in to cancel the decade adjustment mode, the naught (xx0x) decade is set. If the crown 7 is pushed in when the second hand 3A is pointing to 1 to 9 to cancel the decade adjustment mode, the decade is appropriately set to the teens (xx1x) to the nineties (xx9x).

When the decade is manually set in S61, the control unit 30 determines if receiving the week number WN and time of week TOW succeeded (S62), and if reception succeeded, determines the week number WN and time of week TOW from the kept time, reads the dates corresponding to the week number WN from the WN cycle table, adds the time of week TOW to each date, and determines the date in each cycle (S64).

Using the dates for each cycle determined in S64, the date determination unit 36 then looks for a date in which the decade matches the manually set decade (S65).

If a matching date is found, the time adjustment unit 37 adjusts the date of the kept time (S66), and sets the corresponding WN cycle table as the default table (S67). When step S67 is executed, the control unit 30 deletes the manually set decade (date determination information) from the storage unit 31, and ends the decade adjustment mode process.

If S62 returns No, and if S65 returns No, the control unit 30 adjusts the decade of the kept time to the manually set decade (S63), and ends the decade adjustment mode process.

Note that the decade is set using the second hand 3A in this embodiment of the invention, but if the GPS wristwatch 1 has a display unit for the decade, the hand of the decade display unit could be moved by operating a button to set the decade as the date determination information.

This embodiment of the invention executes a process similar to the embodiments described above.

For example, when the process is executed under the same conditions described in the first example in the first embodiment, the time determined from the received data is 2012 y 1 m 2 d 7 h 00 m 06 s because WN=645 and the WN cycle table set as the default is A.

Therefore, the control unit 30 adjusts the kept time to this time, and using the drive circuit 33 adjusts the display unit 40 to the kept time. As a result, the date displayed by the date wheel 8 goes to 2. In addition, when there is a decade display unit, the hand points to the teens (10) decade.

*EXAMPLE 5

Reception without Manually Setting the Decade on a Date not Found in the Default WN Cycle Table The following conditions apply to this example.

Reception location: Tokyo

Reception date: 3 Jul. 2090

Time zone setting: +9 hours

Default WN cycle table: A

Received week number WN and time of week TOW:

WN=645

TOW=79221 s=0 d×86400+22 h×3600+0 m×60+21 s

Because the decade was not manually set before reception in this example, the control unit 30 executes the time adjustment process described below based on the default WN cycle table A (S58).

More specifically, as described above, because WN=645 and TOW=79221, the GPS time is 22 h 00 m 21 s on the first day of week 645 as described in example 1 above.

Also, because WN cycle A is set as the default WN cycle table as described in example 1 above, the week of WN=645 is known to be the week of 1 Jan. 2012 by referring to WN cycle table A in FIG. 5. The first day of week 645 is thus 1 Jan. 2012, and the GPS time based on the received data is 22 h 00 m 21 s on 1 Jan. 2012. UTC is 22 h 00 m 06 s on 1 Jan. 2012, the set time difference is +9 hours, and the current local time and date are 7 h 00 m 06 s on 2 Jan. 2012.

The control unit 30 adjusts the kept time to this time, and the date displayed by the date wheel 8 goes to 2.

However, because the actual date (signal reception date) is 3 Jul. 2090, the user will normally know that the date is wrong, or that the decade is wrong if there is a decade display unit because the indicator will point to 1 (the teens (10) decade), and manually set the decade to 9 (S61 in FIG. 24). Because reception was successful, the control unit 30 returns Yes in S62 and executes step S64.

Because the control unit 30 knows from the year, month, day, hour, minute, second of the kept time (2012 y 1 m 2 d 7 h 00 m 06 s) that the current week number WN and time of week TOW denote day 1 of week 645 (day 2 in Tokyo), the control unit 30 reads the date (year, month, day) of week 645 from WN cycle tables A to E, and adds one day because it is the second day. Using these calculated dates, the control unit 30 then looks for a date of which the decade value matches the date determination information (9 (90 s)) set in S61. This shows that the date with a decade value of 9 is the date defined by the time of week TOW and the week number WN 645 in WN cycle table E (3 Jul. 2090) (S65).

More specifically, as shown in FIG. 5, because the decade of the date of the second day in week 645 is 1 in table A, 3 in table B, 5 in table C, 7 in table D, and 9 in table E, a match between the manually set 9 and the decade of the date in table E is confirmed. As also shown in FIG. 5, because the second day of week 645 starting at the origin (reference date) of WN cycle table E is 3 Jul. 2090, the control unit 30 adjusts the year of the internal time to 2090, the month to 7, and the day to 3 (S66).

The control unit 30 then sets the default WN cycle table to E (S67).

Because the user can check the displayed day or decade after the time is thus adjusted, that the date is correct can be confirmed.

*Operating Effect of Embodiment 3

This embodiment of the invention has the same effect as the foregoing embodiments.

More specifically, if the user manually sets only the decade as the date determination information before or after reception, the current date can be determined using that decade value and the received week number WN and time of week TOW, and the correct time can be set as a result.

Operability can therefore be improved because the correct time can be set by setting only the decade instead of setting the year, month, day as in the prior art.

Furthermore, because the decade value set by the user is a single digit number from 0 to 9, the decade can be set by pointing the second hand 3A to the 0 to 9 hour markers of the timepiece. Because the decade can be easily set using button A 5 and button B 6 similarly to setting the day or the month, usability is excellent.

Yet further, because setting the decade of the date on which the setting operation is performed is sufficient, the time can be automatically adjusted by a simple operation with no particular knowledge about the GPS, and convenience is thus excellent.

Yet further, while the WN cycle tables that can be differentiated by setting the date in the first embodiment is a range of two consecutive WN cycle tables, that is, a range of approximately 39.4 years, this embodiment of the invention can differentiate WN cycle tables covering a span of approximately 98 years as described above and acquire the correct time.

*Embodiment 4

Figure 26:
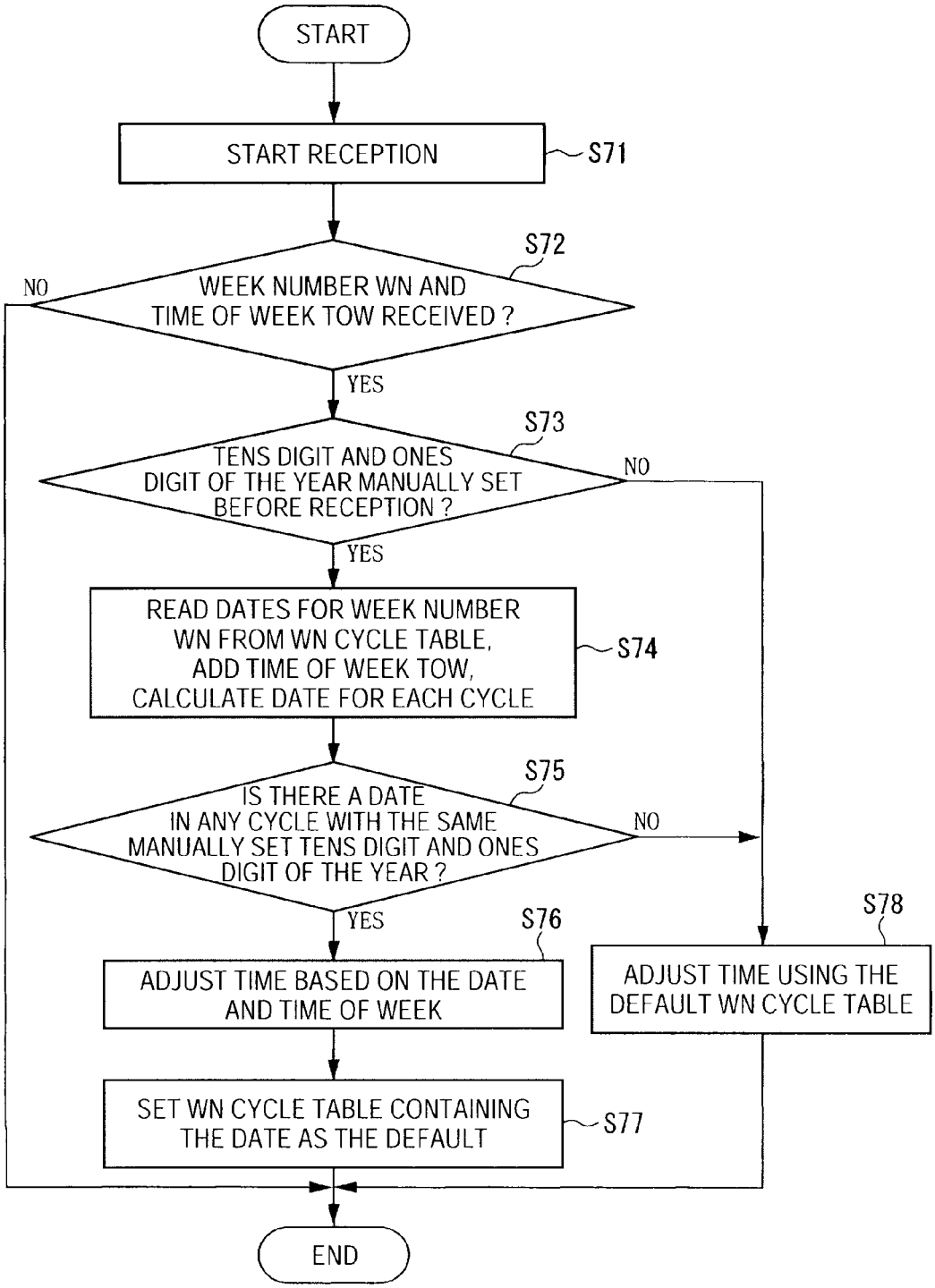
FIG. 26 is a flow chart showing the reception process in the fourth embodiment of the invention.

A fourth embodiment of the invention is described next with reference to FIG. 25, FIG. 26, and FIG. 27.

This fourth embodiment of the invention differs from the previous embodiments by using the tens digit and the ones digit of the Gregorian year instead of the day or the month as the manually set date determination information, and other aspects of the embodiments are the same. The following description of the fourth embodiment therefore addresses the parts that differ from the preceding embodiments, and further description of like parts is omitted.

WN cycle tables as shown in FIG. 5 and described in the previous embodiments are stored in the storage unit 31 of the GPS wristwatch 1 according to the third embodiment of the invention.

However, this embodiment uses the tens digit and the ones digit of the year as the date determination information. Selecting the WN cycle table based on the tens digit and ones digit of the year is described with reference to FIG. 25.

FIG. 25 shows only the tens digit and ones digit of the years extracted from the WN cycle tables in FIG. 5. As shown in FIG. 25, there is no duplication of the lower two digits (the tens digit and ones digit) of the year for any same week number in at least WN cycle tables A to I. These tables can therefore be used for the approximately 176 year span of dates starting from 1 Jan. 2012 (reference date) to 16 Aug. 2188.

Compared with using the day, this embodiment of the invention is compatible with a greater range of years without adjusting the range of WN cycle tables that are searched.

It should be noted that the range of WN cycle tables is A to I in this embodiment of the invention, but this range can be expanded to include tables J, K, and so forth in which the tens digit and ones digit of the years are not duplicated.

The process executed in this fourth embodiment of the invention is the same as in the foregoing embodiments. That is, as shown in FIG. 26 and FIG. 27, the same process as the first embodiment can be used by substituting "tens digit and ones digit of the year" for "day" in the first embodiment.

More specifically, when executing the reception process, the control unit 30 starts reception in S71, determines in S72 if receiving the week number WN and time of week TOW succeeded, and if reception was a success, determines in S73 if the tens digit and ones digit of the year were manually set before reception. If they were manually set, the control unit 30 reads the dates corresponding to the week number WN from the WN cycle table, adds the time of week TOW to each date, and determines the date in each cycle (S74).

Next, using the dates determined for each cycle, the date determination unit 36 looks for a date having a tens digit and ones digit of the year that matches the manually set tens digit and ones digit of the year (S75).

If a matching date is found, the current time is calculated using that date and the time of week TOW, and the kept time is adjusted (S76). In addition, the control unit 30 sets the WN cycle table containing that date as the default table (S77). When step S77 is executed, the control unit 30 deletes the manually set tens digit and ones digit of the year (date determination information) from the storage unit 31, and ends the reception process in FIG. 26.

However, if S73 returns No, and if step S75 returns No, the control unit 30 adjusts the time using the default WN cycle table (S78).

Figure 27:
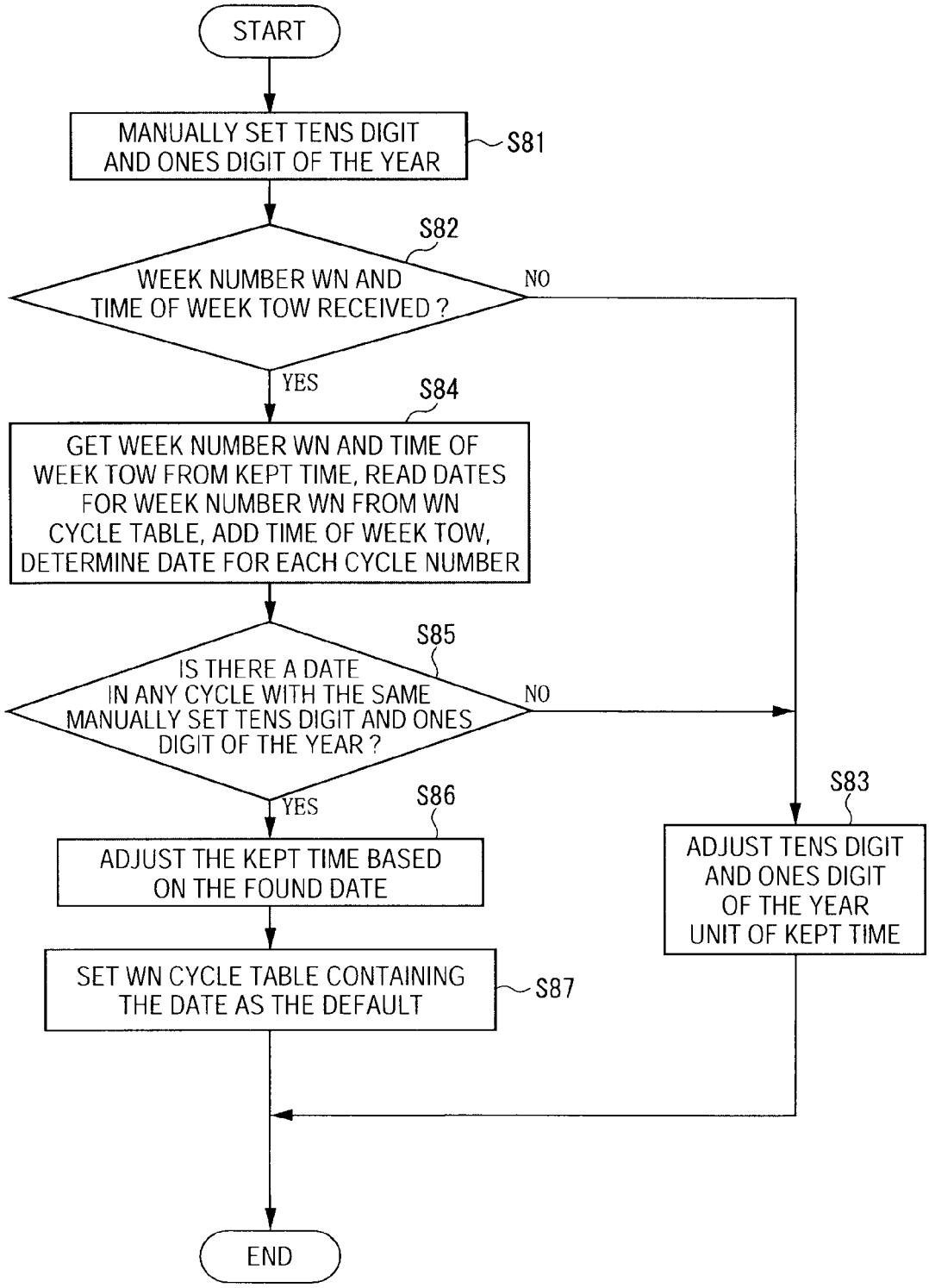
FIG. 27 is a flow chart showing the process for manually setting the tens digit and the ones digit of the year in the fourth embodiment of the invention.

The control unit 30 executes the process shown in FIG. 27 when the tens digit and ones digit of the year adjustment mode is entered. This tens digit and ones digit of the year adjustment mode can be set by pulling the crown 7 out one stop in the same way as the date adjustment mode in the first embodiment.

Because the tens digit and ones digit of the year range from 00 to 99, a two digit number is set (S81). To set a two digit number, the decade (tens digit) can be set using the second hand 3A as in the third embodiment described above, and the ones digit can be set using the date wheel 8. Alternatively, the second hand 3A can be operated twice to, for example, first input the number of the tens digit of the year (the decade) and then set the number of the ones digit (the year).

When the tens digit and ones digit of the year are manually set by the foregoing operation in S82, the control unit 30 determines if receiving the week number WN and time of week TOW succeeded (S62), and if reception succeeded, determines the week number WN and time of week TOW from the kept time, reads the dates corresponding to the week number WN from the WN cycle table, adds the time of week TOW to each date, and determines the date in each cycle (S84).

Using the dates for each cycle determined in S84, the date determination unit 36 then looks for a date in which the tens digit and ones digit of the year match the manually set tens digit and ones digit of the year (S85).

If a matching date is found, the time adjustment unit 37 adjusts the date of the kept time (S86), and sets the corresponding WN cycle table as the default table (S87). When step S87 is executed, the control unit 30 deletes the manually set tens digit and ones digit of the year (date determination information) from the storage unit 31, and ends the tens digit and ones digit of the year adjustment mode process.

If S82 returns No, and if S85 returns No, the control unit 30 adjusts the tens digit and ones digit of the year of the kept time to the manually set tens digit and ones digit of the year (S83), and ends the tens digit and ones digit of the year adjustment mode process.

Note that the tens digit and ones digit of the year are set using the second hand 3A and date wheel 8 in this embodiment of the invention, but if the GPS wristwatch 1 has a display unit such as an LCD panel that can display a two digit number and is configured so that each of the digits can be selectively set by pressing button A 5 and button B 6, the tens digit and ones digit of the year may be set by operating the buttons to change the numbers displayed in the display unit.

This embodiment of the invention executes a process similar to the embodiments described above.

For example, when the process is executed under the same conditions described in the first example in the first embodiment, the time determined from the received data is 2012 y 1 m 2 d 7 h 00 m 06 s because WN=645 and the WN cycle table set as the default is A.

Therefore, the control unit 30 adjusts the kept time to this time, and using the drive circuit 33 adjusts the display unit 40 to the kept time. As a result, the date displayed by the date wheel 8 goes to 2. In addition, when there is a display unit for the tens digit and ones digit of the year, the numbers set in that display unit are displayed.

*EXAMPLE 6

Reception without Manually Setting the Tens Digit and Ones Digit of the Year on a Date not Found in the Default WN Cycle Table The following conditions apply to this example.
Reception location: Tokyo
Reception date: 17 Feb. 2110
Time zone setting: +9 hours Default WN cycle table: A Received week number WN and time of week TOW:

WN=645

TOW=79221 s=0 d×86400+22 h×3600+0 m×60+21 s

Because the tens digit and ones digit of the year were not manually set before reception in this example, the control unit 30 executes the time adjustment process described below based on the default WN cycle table A (S78).

More specifically, as described above, because WN=645 and TOW=79221, the GPS time is 22 h 00 m 21 s on the first day of week 645 as described in example 1 above.

Also, because WN cycle A is set as the default WN cycle table as described in example 1 above, the week of WN=645 is known to be the week of 1 Jan. 2012 by referring to WN cycle table A in FIG. 5. The first day of week 645 is thus 1 Jan. 2012, and the GPS time based on the received data is 22 h 00 m 21 s on 1 Jan. 2012. UTC is 22 h 00 m 06 s on 1 Jan. 2012, the set time difference is +9 hours, and the current local time and date are 7 h 00 m 06 s on 2 Jan. 2012.

The control unit 30 therefore adjusts the kept time to this time, and the date displayed by the date wheel 8 goes to 2.

However, because the actual date (signal reception date) is 17 Feb. 2110, the user will normally know that the date is wrong, or that the tens digit and ones digit of the year are wrong if there is a tens digit and ones digit of the year display unit because 12 will be displayed, and manually set the tens digit and ones digit of the year to 10 (S81 in FIG. 27). Because reception was successful, the control unit 30 returns Yes in S82 and executes step S84.

Because the control unit 30 knows from the year, month, day, hour, minute, second of the kept time (2012 y 1 m 2 d 7 h 00 m 06 s) that the current week number WN and time of week TOW denote day 1 of week 645 (day 2 in Tokyo), the control unit 30 reads the date (year, month, day) of week 645 from WN cycle tables A to I, and adds one day because it is the second day. Using these calculated dates, the control unit 30 then looks for a date of which the tens digit and ones digit of the year match the date determination information (10) set in S81. This shows that the date with a tens digit and ones digit of the year being 10 is the date defined by the time of week TOW and the week number WN 645 in WN cycle table F (17 Feb. 2110) (S85).

More specifically, as shown in FIG. 5, because the tens digit and ones digit of the year of the date of the second day in week 645 is 12 in table A, 31 in table B, 51 in table C, 70 in table D, 90 in table E, 10 in table F, 29 in table G, 49 in table H, and 69 in table I, a match between the manually set 10 and the tens digit and ones digit of the year of the date in table F is confirmed. As also shown in FIG. 5, because the second day of week 645 starting at the origin (reference date) of WN cycle table E is 17 Feb. 2110, the control unit 30 adjusts the year value of the internal time to 2110, the month to 2, and the day to 17 (S86).

The control unit 30 then sets the default WN cycle table to F (S87).

Because the user can check the displayed day or the tens digit and ones digit of the year after the time is thus adjusted, that the date is correct can be confirmed.

*Operating Effect of Embodiment 4

This embodiment of the invention has the same effect as the foregoing embodiments.

More specifically, if the user manually sets only the tens digit and ones digit of the year as the date determination information before or after reception, the current date can be determined using the tens digit and ones digit of the year and the received week number WN and time of week TOW, and the correct time can be set as a result.

Operability can therefore be improved because the correct time can be set by setting only the tens digit and ones digit of the year instead of setting the year, month, day as in the prior art.

Furthermore, because the tens digit and ones digit of the year that are set by the user is a two digit number from 00 to 99, they can be set using button A 5 and button B 6 more easily than a configuration that sets all of the year, month, and day values.

Yet further, because setting the tens digit and ones digit of the year of the date on which the setting operation is performed is sufficient, the time can be automatically adjusted by a simple operation with no particular knowledge about the GPS, and convenience is thus excellent.

Yet further, while the WN cycle tables that can be differentiated by setting the date in the first embodiment is a range of two consecutive WN cycle tables, that is, a range of approximately 39.4 years, this embodiment of the invention can differentiate WN cycle tables covering a span of approximately 176 years as described above and acquire the correct time.

*Other Variations

It will be obvious to one with ordinary skill in the related art that that the invention is not limited to the embodiments described above, and can be varied in many ways without departing from the scope of the accompanying claims.

Figure 28:
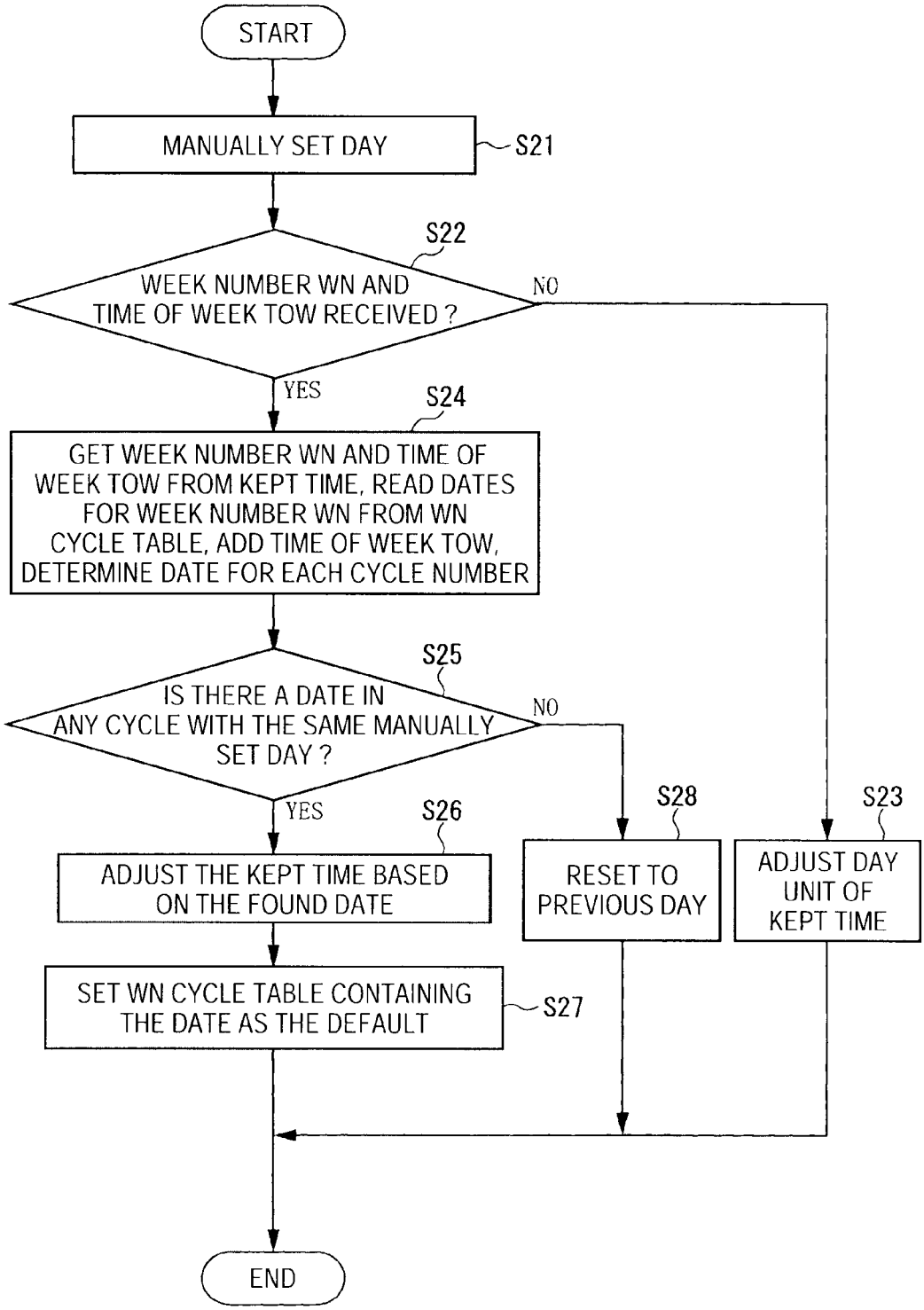
FIG. 28 is a flow chart showing the process for manually setting the day in another embodiment of the invention.

For example, when the day is manually set (S21), reception succeeds (S22 returns Yes), and the corresponding date is not found (S25 returns No) in the first embodiment described above, the day value of the kept time is adjusted using the manually set day in the same way as when reception did not succeed, but as shown in S28 in FIG. 28, the day value that was used before being manually set may be reset when a corresponding date is not found.

When, for example, the corresponding date cannot be found even though reception is successful because the user set the wrong day, this process resets the date displayed by the date wheel 8 to the day displayed before being manually set. The user can therefore easily know that the wrong day was set, can then reset the correct day, and thereby increase the likelihood of being able to set the correct time.

Note that this process of returning to the state before adjustment is not limited to the first embodiment and can also be applied in the second to fourth embodiments.

Furthermore, when a corresponding date is not found in S25 in the first embodiment, the day value of the kept time is adjusted to the day set by the user in S23. However, if the day is set to a nonexistent date that does not actually exist, the day of the kept time can be automatically adjusted to the 1st and the month value can be incremented +1 when the date adjustment mode is cancelled.

For example, if the kept time is April 15 and the user manually sets the date to the 31st, the kept time is adjusted to April 31 in S23. However, because April 31 is a nonexistent date, the kept time may be automatically adjusted to May 1. This prevents problems such as adjusting the kept time to a date that does not exist.

The control unit 30 may also automatically execute an end-of-month calendar process for the year, month, day of the kept time after reception succeeds and the time is adjusted using the week number WN and time of week TOW. This end-of-month calendar process automatically advances the date to the 1st of the next month on any nonexistent date such as February 30 or April 31. In addition, leap years can be determined from the year.

Furthermore, WN cycle tables are prepared and stored in the storage unit 31 as week number cycle information linking week number, cycle number, and date values in the foregoing embodiments, but because the week number is updated every week, the necessary week number cycle information can be computed.

More specifically, as long as the reference date of the week number is set, other times and dates can be computed therefrom. For example, if 1 Jan. 2012 is set as the reference date of week number 645, the start of the week of week number 646 can be calculated as 8 Jan. 2012 by adding 7 days to the reference date. The start of week number 645 in the second cycle (cycle number 2) can be calculated by adding 1024 weeks to 1 Jan. 2012, resulting in a starting date of 17 Aug. 2031.

The search range in the WN cycle tables in the foregoing embodiments can also be sequentially changed referenced to the default WN cycle table.

For example, when the WN cycle tables are differentiated using the day in the first embodiment, two consecutive WN cycle tables must be set as the search range. If the default WN cycle table is A in this configuration, the search range is set to WN cycle tables A and B; if the default WN cycle table is B, the search range is set to WN cycle tables B and C; if the default WN cycle table is C, the search range is set to WN cycle tables C and D. More specifically, when the WN cycle table to which the current date belongs is identified and that WN cycle table is set as the default by the process of the invention, there is no need to include a WN cycle table for dates older than the default WN cycle table in the search range, and the search range can be limited to future WN cycle tables.

By thus changing the search range whenever the default WN cycle table changes, the actual search range can be expanded even when the search range is two consecutive WN cycle tables, and the number of years with which the timepiece is compatible can be increased.

Note that the search range can also be changed each time the default WN cycle table is changed in the second to fourth embodiments described above.

The default WN cycle table is changed when the WN cycle table that is used is changed to a new table in the foregoing embodiments, but if the date changes to the range of the next WN cycle table at the kept time count, the default WN cycle table may also be changed at the same time.

For example, in the WN cycle tables shown in FIG. 5, the default WN cycle table may be changed from A to B when the date of the kept time changes from 2031/8/16 (week 644) to 2031/8/17 (week 645).

Yet further, the reference date of the WN cycle tables in the foregoing embodiments is set to day 1 of week number WN=645, but the WN cycle table may be set using the date on which reception succeeded as the reference date. For example, if the reference date is set to 2012/1/1 (week 645) and reception succeeds on 2019/4/7 (week 0), the new reference date may be set to 2019/4/7 (week 0) and weeks 0 to 1023 can be changed to the range of each WN cycle table. When the search range is thus set, the date determination information need not be manually set for at least 1024 weeks (19.7 years) from the reception date, the correct time can be acquired by reception alone using the default WN cycle table, and usability can be improved.

Furthermore, the WN cycle tables (week number cycle information) in the foregoing embodiments correlate week number WN, cycle number, and the dates corresponding thereto as shown in FIG. 5, but may be configured with only part of the week number WN, cycle number, and corresponding dates. For example, when part of the date is the day, the tables can be configured as shown in FIG. 6. The day of each cycle number is then read from the week number WN, and the time of week is added. If the number of the date determination information matches one of those numbers, the cycle number containing that number is known. In addition to the day, the year and month can be calculated from the cycle number using the set reference date, week number, time of week, and cycle number. If the WN cycle table (week number cycle information) is configured with part of the date, less storage unit capacity is needed than when the full date is used.

Yet further, the day, month, decade of the Gregorian year, and tens digit and ones digit of the Gregorian year are set as the date determination information in the foregoing embodiments, but the date determination information is not limited thereto. For example, any combination of the day, month, ones digit of the Gregorian year, tens digit (decade) of the Gregorian year, hundreds digit (century) of the Gregorian year, and thousands digit of the Gregorian year may be used as the date determination information.

However, only the ones digit of the Gregorian year, only the hundreds digit (century) of the Gregorian year, and only the thousands digit of the Gregorian year cannot be used as the date determination information of the invention because the same values will be duplicated in adjacent WN cycle tables. These values must therefore be used in combination with another value.

Furthermore, the default value of the WN cycle table may be stored in nonvolatile memory so that the value is retained even after initialization. More specifically, the default WN cycle table can be used for approximately 19.7 years. During this time the battery will be replaced multiple times, and the GPS wristwatch 1 will be initialized multiple times. If the default value of the WN cycle table is also erased, the default WN cycle table must be reset every time the battery is replaced, and storing the default value in nonvolatile memory has the advantage of making resetting the default value unnecessary.

Note that when selecting the default WN cycle table after the GPS wristwatch 1 is initialized, the crown 7 may be operated to enter a WN cycle table adjustment mode, and button A 5 and button B 6 pressed to move the second hand 3A to one of the hour markers 1 to 12 so that, for example, WN cycle table A is selected if the second hand 3A is set to 1, and WN cycle table B is selected if set to 2.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The satellite signal reception device according to the invention is not limited to analog timepieces having hands, and can be applied to combination timepieces having hands and a display, as well as digital timepieces having only a display. The invention is also not limited to wristwatches, and can be applied to other timepieces such as table clocks and pocket watches, as well as various types of information terminal devices having a timekeeping function, including cell phones, digital cameras, personal navigation devices, and car navigation systems.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece comprising:

a receiving unit that receives satellite signals transmitted from positioning information satellites, and acquires a week number that is incremented once a week and reset after a specific cycle, and a time of week denoting the date and time in the week identified by the week number;

a timekeeping unit that keeps time;

an operating unit that can be manually operated by a user;

a date determination information setting unit that sets a unit that is part of a date composed of year, month, and day values set using the operating unit as date determination information;

a date determination unit that determines the date based on the week number, the time of week, and the date determination information; and a time adjustment unit that determines the time expressed by the current year, month, day, hour, minute, second based on the date determined by the date determination unit and the time of week, and adjusts the time kept by the timekeeping unit;

wherein when the week number indicates an n-th cycle from a specific reference date as a cycle number, the date determination information setting unit sets the date determination information using a partial unit that is a different number in each date corresponding to the same week number in a plurality of consecutive cycle numbers, and the date determination unit acquires the date in each cycle number identified by the week number and time of week based on week number cycle information correlating week numbers, cycle numbers, and dates, and determines in which of these dates the partial unit matches the date determination information.

2. The electronic timepiece described in claim 1, wherein:

the date determination information setting unit updates the date determination information set by the operating unit in conjunction with the unit corresponding to the date determination information in the time kept by the timekeeping unit.

3. The electronic timepiece described in claim 1, wherein:

the date determination information is any one of a number denoting the day, a number denoting the month, a number denoting the tens digit of the Gregorian year, a two digit number including the tens digit and ones digit of the Gregorian year, and a two digit number including the hundreds and the tens digits of the Gregorian year.

4. The electronic timepiece described in claim 1, wherein:

the date determination unit and the time adjustment unit operate immediately after the week number and time of week are first received after the date determination information is set by the date determination information setting unit, or immediately after the date determination information is first set by the date determination information setting unit after the week number and time of week are received by the receiving unit.

5. The electronic timepiece described in claim 1, wherein:

when a date matching the date determination information is not found, the date determination unit determines and outputs the date identified by a default cycle number that is preset in the week number cycle information, the week number, and the time of week; and the time adjustment unit determines the current time based on the date output from the date determination unit and the time of week, and adjusts the time kept by the timekeeping unit.

6. The electronic timepiece described in claim 1, wherein:

when the week number and time of week are received when the date determination information has not been set by the date determination information setting unit, the time adjustment unit obtains the current time based on the default cycle number preset in the week number cycle information, and the received week number and time of week, and adjusts the time kept by the timekeeping unit.

7. The electronic timepiece described in claim 5, wherein:

when a date that matches the date determination information is found in the dates of each cycle number, the date determination unit sets the cycle number of the cycle containing the date as the default cycle number.

8. The electronic timepiece described in claim 1, wherein:

when the date determination information is set by the date determination information setting unit when the week number and time of week have not been received after the electronic timepiece is initialized, the time adjustment unit adjusts only the unit of the time kept by the timekeeping unit that corresponds to the set date determination information to the date determination information.

9. The electronic timepiece described in claim 1, wherein:

when a date that matches the date determination information is found in the dates of each cycle number, the date determination unit sets the data following that date as the search range, and thereafter when determining the date, determines the date based on data in the search range.

10. A time adjustment method for an electronic timepiece that has a receiving unit that receives satellite signals transmitted from positioning information satellites, and acquires a week number that is incremented once a week and reset after a specific cycle, and a time of week denoting the date and time in the week identified by the week number using time passed from a time identified by the week number, a timekeeping unit that keeps time, and an operating unit that can be manually operated by a user, the time adjustment method comprising:

a date determination information setting step that sets a unit that is part of a date composed of year, month, and day values set using the operating unit as date determination information;

a date determination step that determines the date based on the week number, the time of week, and the date determination information; and a time adjustment step that determines the time expressed by the current year, month, day, hour, minute, second based on the date determined by the date determination step and the time of week, and adjusts the time kept by the timekeeping unit;

wherein when the week number indicates an n-th cycle from a specific reference date as a cycle number, the date determination information setting step sets the date determination information using a partial unit that is a different number in each date corresponding to the same week number in a plurality of consecutive cycle numbers, and the date determination step acquires the date in each cycle number identified by the week number and time of week based on week number cycle information correlating week numbers, cycle numbers, and dates, and determines in which of these dates the partial unit matches the date determination information.

* * * * *